US007682766B2

(12) United States Patent
Fujimoto et al.

(10) Patent No.: US 7,682,766 B2
(45) **Date of Patent: *Mar. 23, 2010**

(54) ELECTROPHOTOGRAPHIC IMAGE FORMING METHOD AND IMAGE FORMING APPARATUS

(75) Inventors: Shingo Fujimoto, Fussa (JP); Takao Yamanouchi, Sagamihara (JP); Hirofumi Koga, Hino (JP); Masaaki Kondo, Hachioji (JP); Shiro Hirano, Hachioji (JP); Junya Onishi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 315 days.

This patent is subject to a terminal disclaimer.

(21) Appl. No.: 11/736,818

(22) Filed: Apr. 18, 2007

(65) Prior Publication Data

US 2007/0254233 A1 Nov. 1, 2007

(30) Foreign Application Priority Data

Apr. 27, 2006 (JP) ..... 2006-123180
May 25, 2006 (JP) ..... 2006-144978

(51) Int. Cl.
*G03G 13/16* (2006.01)

(52) U.S. Cl. ..... 430/123.42; 430/119.71; 430/119.86; 430/125.3

(58) Field of Classification Search ..... 430/123.42, 430/126.2, 119.7, 119.8, 119.71, 119.86, 430/125.3

See application file for complete search history.

(56) References Cited

U.S. PATENT DOCUMENTS

| | | | | |
|---|---|---|---|---|
| 2002/0076633 | A1* | 6/2002 | Niimi | 430/59.6 |
| 2005/0202335 | A1* | 9/2005 | Yoshizawa et al. | 430/124 |
| 2006/0269335 | A1* | 11/2006 | Takahashi | 399/346 |

FOREIGN PATENT DOCUMENTS

| | | |
|---|---|---|
| JP | 56117245 | 9/1981 |
| JP | 57176057 | 10/1982 |
| JP | 61117558 | 6/1986 |
| JP | 63091666 | 4/1988 |
| JP | 01205171 | 8/1989 |
| JP | 2002005064 | 1/1990 |
| JP | 03155558 | 7/1991 |
| JP | 08202062 | 8/1996 |
| JP | 2000275892 | 10/2000 |
| JP | 2003316203 | 11/2003 |

* cited by examiner

*Primary Examiner*—John L Goodrow
(74) *Attorney, Agent, or Firm*—Lucas & Mercanti, LLP

(57) ABSTRACT

In an image forming method in which a toner image, which is visualized via an electrostatic latent image formed on an electrophotographic photoreceptor, employing a developer incorporating toner, is transferred onto a recording material followed by fixing, and any residual toner remaining on the electrophotographic photoreceptor is removed, an image forming method in which an electrophotographic photoreceptor and a toner which satisfy specified requirements are employed and image formation is carried out while feeding a surface energy lowering agent from the developer onto the aforesaid electrophotographic photoreceptor, and an image forming apparatus employing the same.

30 Claims, 3 Drawing Sheets

ELECTROPHOTOGRAPHIC IMAGE FORMING METHOD AND IMAGE FORMING APPARATUS

This application is based on Japanese Patent Application No. 2006-123180 filed on Apr. 27, 2006, and No. 2006-144978 filed on May 25, 2006, in Japanese Patent Office, the entire content of which is hereby incorporated by reference.

TECHNICAL FIELD

The present invention relates to an image forming method based on an electrophotographic system, which is employed in copiers, printers, and facsimile machines, and an image forming apparatus.

BACKGROUND OF THE INVENTION

Realization capable of allowing toner to undergo fixing at a lower temperature by lowering its softening point and glass transition point (Tg) relates to a decrease in the temperature during the fixing process, whereby it is possible to achieve significant energy saving of the electrophotographic process. Further, realization capable of achieving fixing at a lower temperature, namely at lower heat energy, makes it possible to match to a high rate process, resulting in beneficial productivity enhancement of copiers and printers. However, a mere decrease in thermal physical properties such as softening point or glass transition point of the toner degrades retaining properties and aggregation properties of the toner, whereby various adverse effects, such as developability degradation or localized clogging due to decrease in fluidity of the toner in the apparatus, occur. Even though retaining properties are improved via external additive techniques (such as the addition of fluidizing agents such as silica), drawbacks occur in which cleaning properties of the photoreceptor are degraded in a process employing a conventional electrophotographic photoreceptor, while employing a toner exhibiting lower thermal physical properties and an easily thermally deformable toner tends to adhere to the photoreceptor, so-called toner filming tends to occur, whereby use over a long period of time results in problems. Further, in full-color electrophotographic processes, which have increasingly been realized in recent years, image forming systems employing an intermediate transfer body are primarily employed. In such systems, a toner exhibiting lower thermal physical properties results in a decrease in the transfer ratio which is adversely affected by fusion onto the intermediate transfer body, whereby problems occur in which image defects such as center lower density or toner dots near characters tend to occur.

Known as a method to improve cleaning properties of residual toner on the electrophotographic photoreceptor and abrasion resistance of the electrophotographic photoreceptor is that endurance can be enhanced by increasing mechanical strength of the surface of a photoreceptor via incorporating hydrophobic silica into its uppermost layer (refer, for example, to Patent Documents 1-3). Further, it is known that by incorporating hydrophobic silica particles, prepared by treating the above hydrophobic silica with a silane coupling agent, into the uppermost layer of the photoreceptor, the mechanical strength of the photoreceptor is enhanced, and simultaneously, lubricants (metal carboxylates) are added, whereby photoreceptors exhibit higher endurance are prepared (refer, for example, to Patent Documents 4-6).

Further disclosed as a method to improve insufficient hydrophobicity of the above silica particles, which have been subjected to hydrophobic treatment, is a technique in which sintered silica is applied onto the surface layer of the photoreceptor (refer to Patent Document 7). Namely, described is a photoreceptor incorporating hydrophobic silica of an endothermic energy variation amount ΔH in the range of 40-200° C. of 0-20 J/g based on differential scanning calorimetry in the case of re-humidification under relative humidity of 80%, and a volume average particle diameter of 0.05-2 μm, and sintered silica is employed as hydrophobic silica particles employed in the aforesaid photoreceptor.

The above methods exhibit effects to improve cleaning properties of the residual toner on the electrophotographic photoreceptor as well as abrasion resistance of the electrophotographic photoreceptor. However, during image formation employing a low Tg toner, the resulting effects have been insufficient for the demanded higher level of the markets in which no image defects (such as center low density or toner dots near characters) occur.

(Patent Document 1) Japanese Patent Publication Open to Public Inspection (hereinafter referred to as JP-A) No. 56-117245

(Patent Document 2) JP-A No. 63-91666

(Patent Document 3) JP-A No. 1-205171

(Patent Document 4) JP-A No. 57-176057

(Patent Document 5) JP-A No. 61-117558

(Patent Document 6) JP-A No. 3-155558

(Patent Document 7) JP-A No. 8-202062

SUMMARY OF THE INVENTION

In view of the foregoing, the present invention was achieved. An object of the present invention is to provide an image forming method and an image forming apparatus which realize enhancement of transferability and fixability of a toner image at low temperature, minimization of center low density, toner dots near characters, and toner filming, and enhancement of cleaning properties of the photoreceptor during the electrophotographic process, and namely enabling further energy saving and adaptability for a higher rate of the electrophotographic process.

The above problems associated with the present invention are solvable by the following methods.

1. In an image forming method in which a toner image, which is visualized via an electrostatic latent image formed on an electrophotographic photoreceptor, employing a developer comprising toner, is transferred onto a recording paper followed by fixing, and any residual toner remaining on the electrophotographic photoreceptor is removed, an image forming method wherein the aforesaid electrophotographic photoreceptor contains, in the surface layer, inorganic minute particles having a number average diameter of the primary particles of 1-100 nm, an endothermic energy variation amount ΔH is 0.1-10 J/g in differential scanning calorimetry, and a glass transition temperature (Tg) of the aforesaid toner is 20-40° C., and an interfacial adhesion force (Fr) between the aforesaid toner and polytetrafluoroethylene is 1.0-3.5 N, and image formation is carried out while providing the aforesaid surface energy lowering agent onto the aforesaid electrophotographic photoreceptor.

The surface energy lowering agents may be incorporated in toner and may be provided onto the surface of the electrophotographic photoreceptor from the toner, while a surface energy lowering agent providing member may be arranged and the agents may be provided employing the same.

2. The image forming method, described 1. above, wherein the aforesaid surface energy lowering agent is a fatty acid metal salt.

3. The image forming method, described in 1. or 2. above, wherein the aforesaid inorganic minute particles are composed of silica.
4. An image forming apparatus wherein image formation is carried out employing the image forming method described in any one of 1.-3. above.

It is possible to provide an image forming method and an image forming apparatus which realize enhancement of transferability and fixability at low temperature of a toner image, minimized center low density, toner dots near characters, and toner filming, and enhancement of cleaning properties of a photoreceptor during the electrophotographic process, based on the above embodiments of the present invention.

EMBODIMENTS

Figure 1:
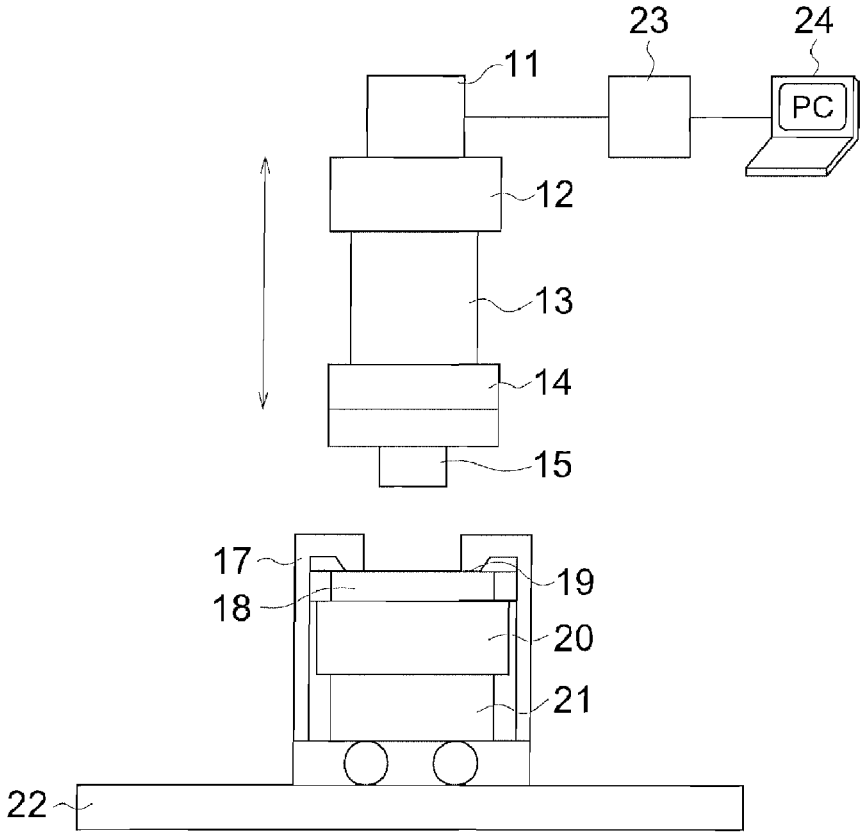
FIG. 1 is a schematic view showing one example of a measurement instrument of interfacial adhesion force (Fr) and inner aggregation force (Ft).

The image forming method of the present invention follows. In an image forming method in which a toner image, which is visualized via an electrostatic latent image formed on an electrophotographic photoreceptor, employing a developer incorporating toner, is transferred onto a recording paper followed by fixing, and any residual toner remaining on the electrophotographic photoreceptor is removed, the aforesaid electrophotographic photoreceptor incorporates, in its surface layer, inorganic minute particles at a number average diameter of the primary particles of 1-100 nm, the endothermic energy variation amount ΔH is 0.1-10 J/g determined via differential scanning calorimetry, the glass transition temperature (Tg) of the aforesaid toner is 20-40° C., and interfacial adhesion force (Fr) between the aforesaid toner and polytetrafluoroethylene is 1.0-3.5 N. Image formation is carried out while supplying the aforesaid surface energy lowering agent onto the aforesaid electrophotographic photoreceptor.

The surface energy lowering agents may be incorporated in the toner and may be supplied onto the electrophotographic photoreceptor from the toner. Further, a surface energy lowering agent providing member may be arranged and the agents may be fed employing the same.

The present invention and its constituting component elements and so on will now be detailed.

<<Electrophotographic Photoreceptor>>

The layer configuration of the electrophotographic photoreceptor is not particularly limited as long as a surface layer is present. The layer is basically, composed of photosensitive layers such as a charge generating layer, a charge transport layer, or a charge generating/charge transport layer (a single layer performing charge generation and charge transport) and a surface layer coated thereon. Further, it is preferable that the surface layer functions as a protective layer as well as for a charge transport function. The coated layer includes an inter layer and the photosensitive layers and the surface layer mentioned above. An interlayer may be provided on a substrate of the photoreceptor.

The number average diameter of the primary inorganic minute particles incorporated in the surface layer of the electrophotographic photoreceptor is commonly 1-100 nm, is preferably 10-90 nm, but is most preferably 10-50 nm. When the number average diameter of inorganic minute particles incorporated in the surface layer is less than 1 nm, minute unevenness is not formed on the surface of a photoreceptor resulting in insignificant improvement effects of transferability and cleaning properties of the above toner. On the other hand, in the case of inorganic minute particles of 100 nm or more, endothermic energy variation ΔH, measured via differential scanning calorimetry of the coated layer of the photoreceptor determined in the range of 35-300° C. after re-humidification under 30° C. and 80% relative humidity tends to exceed 10 J/g. When ΔH exceeds 10 J/g, compounds resulting in carrier traps, such as water molecules, increases, whereby environmental memory tends to be generated. Further, blade abrasion increases resulting in insufficient cleaning. Endothermic energy variation ΔH of the coated layer of the photoreceptor is commonly 0.1-10 J/g, but is more preferably 2.0-8.0 J/g.

As the inorganic minute particles having particle diameter of 1-100 nm employed in the surface layer, include a fine particles of silica, zinc oxide, titanium oxide, tin oxide, antimony oxide, indium oxide, bismuth oxide, tin-doped indium, antimony- of tantalum-doped tin oxide and zirconium oxide. Among them, silica, particularly hydrophobic silica hydrophobilized at the surface thereof, is preferable from the viewpoint of the cost, easiness of the diameter control and that of the surface treatment.

The number average primary particle diameter of the inorganic minute particles is defined by the number average of the FERE diameter according to the image analyzing of 300 primary particles randomly selected from an electron microscopic image with a magnitude of 10,000.

The hydrophobicity of the hydrophobic inorganic minute particles is preferably 50% or more in terms of methanol wettability that is a measure of wettability against methanol. In case that the hydrophobicity is not more than 50%, a difference of absorption heat energy ΔH easily becomes greater than 10 J/g, and therefore, environ memory is easy to generate. Preferable hydrophobicity is 65% or more and more preferably 70% or more.

The methanol wettability representing hydrophobicity of inorganic minute particles is to evaluate the wettability of inorganic minute particles to methanol. Measurement of wettability is performed by the following methods. In this method, 0.2 g of inorganic minute particles is weighed and added to 50 ml of distilled water placed in a 250 ml beaker. Methanol is slowly added dropwise while slowly stirring from a burette of which top is immersed in the solution until entire inorganic minute particles become wet. When "a" (in ml) represents the amount of methanol required for making silica fine powder perfectly wet, the degree of hydrophobicity is calculated from the formula given (1):

$$\text{Degree of hydrophobicity}=a/(a+50)\times 100 \quad (1)$$

Preferable example of the inorganic minute particles is silica, and particularly preferably hydrophobic silica.

The above-mentioned hydrophobic silica can be obtained by hydrophobilizing silica powder generated with a well-known wet method or a well-known dry process. Especially, hydrophobic silica in which so-called fumed silica generated by a dry process (vapor phase oxidation of a siliconized halogen compound) is processed with a hydrophobilizing agent is desirable, because water content adsorption sites are few. This is a product conventionally manufactured by well-known technology. For example, the technology utilizes a pyrolysis oxidation reaction in the hydrogen oxide flame of silicon tetrachloride gas, based on the following formula.

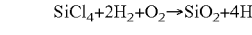

$$SiCl_4+2H_2+O_2 \rightarrow SiO_2+4HCl$$

Moreover, in this manufacturing process, it is also possible to obtain a composite fine powder of silica and other metal oxides by using other metal halogenated compounds, such as an aluminum chloride or a titanium chloride, with a silicon halogenated compound.

The hydrophobilizing process of the inorganic minute particles (for example, silica powder) can be performed by the following conventionally known methods: a dry processing in which for inorganic minute particles dispersed in a state of a cloud by stirring, a hydrophobilizing process agent solution dissolved in alcohol is sprayed to the powder or an evaporated hydrophobilize process agent is contacted and is made to adhere to the powder, or a wet processing which distributes the silica powder in a solution and drops a hydrophobilize process agent and adhere to the powder.

A known compound can be used as the hydrophobilizing process agent, and a concrete example is listed below. Moreover, these compounds may be combined and used.

As a titanium coupling agent, tetrabutyl titanate, tetraoctyl titanate, isopropyl-triisostearoyl titanate, isopropyl-tridodecylbenzenesulfonyl titanate, bis(dioctylpyrophosphate)oxyacetate titanate, etc. can be listed.

As a Silane coupling agent, γ-(2-aminoethyl)aminopropyltrimethoxysilane, γ-(2-aminoethyl)aminopropylmethyldimethoxysilane, γ-methacryloxypropyltrimethoxysilane, N-β-vinyl-benzylaminoethyl-N-γ-aminopropyltrimethoxysilane hydrochloride, hexamethyldisilazane, methyltrimethoxysilane, butyltrimethoxysilane, isobutyl trimethoxysilane, hexyltrimethoxysilane, octyltrimethoxysilane, decyltrimethoxysilane, dodecyltrimethoxysilane, phenyltrimethoxysilane, o-methylphenyl trimethoxysilane, p-methylphenyl trimethoxysilane, etc. are may be listed.

As a silicone oil, dimethylsilicone oil, methylphenylsilicone oil, amino-modified-silicone oil, etc. are may be listed. As for these hydrophobilizing process agents, it is preferable to add 1 to 40 weight % for silica powder so as to cover the silica powder, and to add 3 to 30 weight % is more preferable.

A hydrogen polysiloxane compound may be used as the above-mentioned surface hydrophobilizing agent. Generally, as for the hydrogen polysiloxane compound, the compound having a molecular weight of 1,000-20,000 may be obtainable, and its black spot occurrence prevention function is also good. Suitable effect can be obtained when methylhydrogenpolysiloxane is used for the final surface treatment.

The above hydrophobic silica, which has been subjected to a hydrophobic treatment, is, together with binders, incorporated in the surface layer of an electrophotographic photoreceptor. The ratio of the hydrophobic silica to the binders is commonly 1-20% by weight, is preferably 2-15% by weight, but is most preferably 2-10% by weight. When the ratio exceeds 20% by weight, it becomes difficult to decrease endothermic energy variation ΔH of the photoreceptor to at most 10 J/g, resulting in degradation of environmental memory and toner transferability, whereby insufficient cleaning tends to occur. On the other hand, when it is less than 1% by weight, abrasion resistance of the photoreceptor tends to be degraded.

In order to decrease endothermic energy variation ΔH of the coated layer of the photoreceptor to at most 10 J/g, it is preferable to employ hydrophobic silica particles of a number average diameter of the primary particles of 1-100 nm, which are incorporated in the surface layer of the photoreceptor and at the same time, to decrease water absorbability of binders employed in each layer constituting the photoreceptor. Particularly, it is preferable to select binder resins so that the water absorption of the surface layer and the intermediate layer decreases. Namely, under high temperature and high humidity, water molecules tend to migrate to the photosensitive layer via the surface and the electrically conductive support. In order to minimize the above migration, it is critical to decrease water absorbability of the surface layer and also of the intermediate layer. It is further critical to decrease water absorbability of the binders in the charge transport layer, which occupies the maximum volume in the photosensitive layer.

It is possible to decrease endothermic energy variation ΔH to at most 10 J/g by making the minute inorganic minute particles in the surface layer hydrophobic, and simultaneously decreasing the water absorption ratio of binders of the above surface layer.

Namely, it is preferable that binder resins employed in the surface layer are selected from those which are substantially non-hygroscopic in such a manner that their water absorption is at most 0.5%, but is preferably at most 0.3% by weight. Preferably employed as such binder resins are polycarbonate, polyester, and polyallylate, and polycarbonate is particularly preferred since it exhibits the desired electrophotographic characteristics.

(Measurement Method of Endothermic Energy Variation ΔH)

1. Measurement of Endothermic Energy Variation ΔH of the Coated Layer of the Photoreceptor Differential scanning calorimetry (DSC) of a coated layer of the photoreceptor can quantitatively be determined via the following formula, being based on the fact that the peak area of DSC is proportional to the endotherm, employing a method in which when a sample is heated at a constant rate together with a thermally stable material, energy to overcome the temperature difference between both is provided.

$$M \cdot \Delta H = K \cdot A$$

wherein M represents the weight of a sample, ΔH represents the energy variation per unit weight of the sample, K represents the instrument constant, and A represents the peak area.

The coated layer of the photoreceptor includes an interlayer, a photosensitive layer including a charge generation layer and charge transfer layer, a surface layer, a protective layer and so on coated on the support of the photoreceptor.

Determination of the above was carried out as follows. The photoreceptor prepared in the example rehumidified while being standing at 30° C. and 80% relative humidity for 24 hours. Thereafter, until DSC determination, the resultant photoreceptor was sealed in a vessel and subjected to determination under the following conditions within 60 minutes after re-humidification. The photosensitive layer is cut into a piece of 5 mm square for the measurement.

Endothermic energy variation ΔH of the coated layer of the photoreceptor is calculated by drawing the value of the substrate from the value of the photoreceptor piece as a whole.

Instrument: differential scanning calorimeter DSC-20

Thermal controller: SSC-580 (produced by Seiko Instruments, Inc.)

Measuring Conditions

Measurement temperature: 35-300° C.

Temperature elevating rate: 10° C./minute

Measurement environment: still air atmosphere

Water absorption of binders of a surface layer, as described herein, refers to the weight average water absorption of the entire layer forming binder resins incorporated in the surface layer. When at least two types of layer forming binder resins are incorporated, it is preferable to select binders so that the weight average water absorption of each binder is commonly at most 1.0%, but is preferably at most 0.5%. For example, when 5 g of Resin A at a water absorption of 1.5% and 10 g of Resin B at a water absorption of 0.5% are employed as a binder resin in the surface layer, the water absorption of the surface layer will be (1.5×5+0.5×10)/(5+10)=0.83%.

On the other hand, sought are binder resins for the intermediate layer to satisfy characteristics such as adhesion properties to electrically conductive supports and charge generating layers, or blocking properties of free carriers from an electrically conductive support, whereby polar group incorporating resins at a volume resistance of $10^9$-$10^{13}$ Ωcm are preferred. Preferably employed as a resin, which exhibits the above resistance properties and improved solvent solubility, are polyamide resins. Water absorption is commonly at most 5%, but is preferably at most 3%. When the water absorption of binders in the intermediate layer is at least 5%, moisture in the photosensitive layer increases through the intermediate layer, resulting in higher environmental memory. Herein, the water absorption of binder resins of the intermediate layer is as defined for resins of the above surface layer.

Listed as polyamide resins which satisfy the above characteristics are those which have the following chemical structure.

N-1

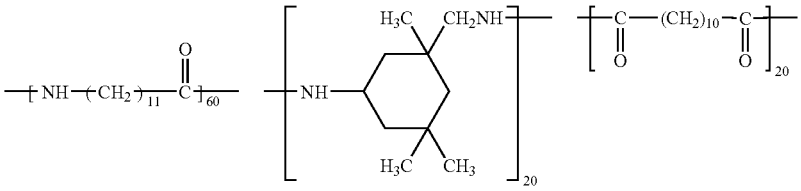

N-2

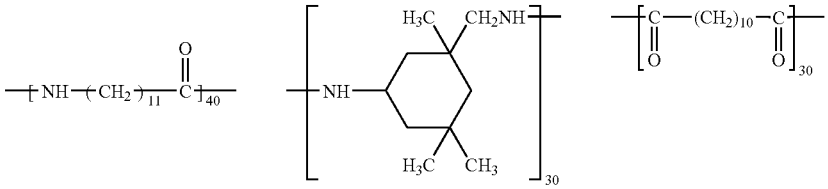

N-3

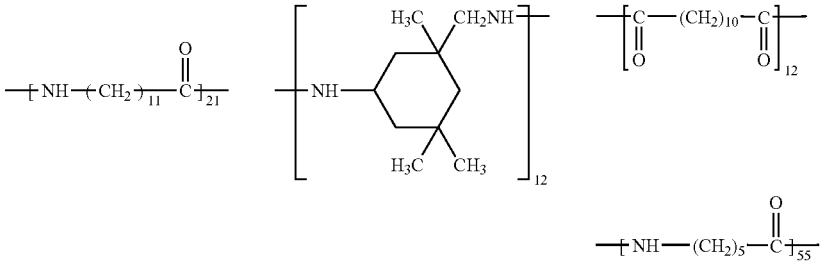

N-4

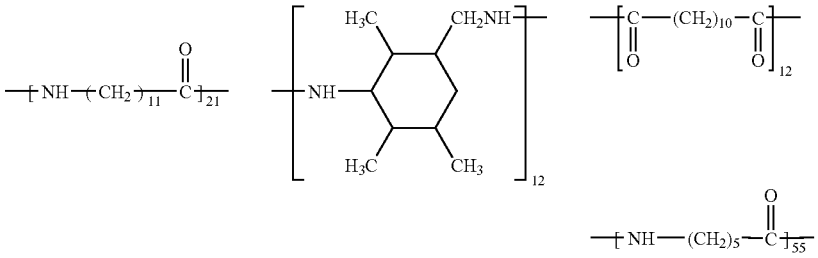

-continued

N-5

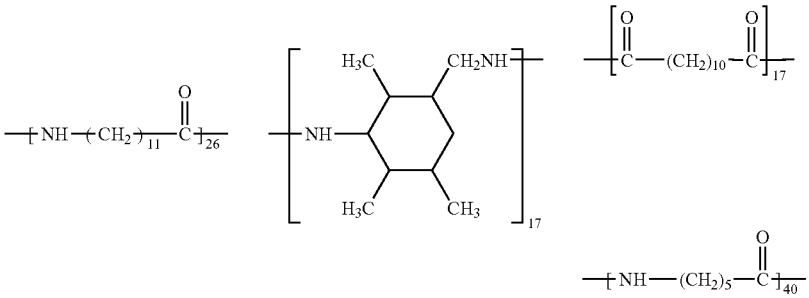

N-6

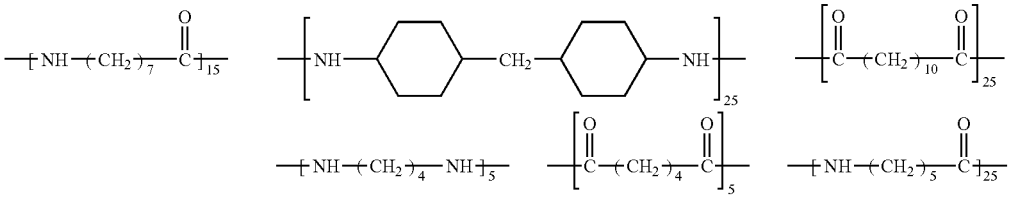

N-7

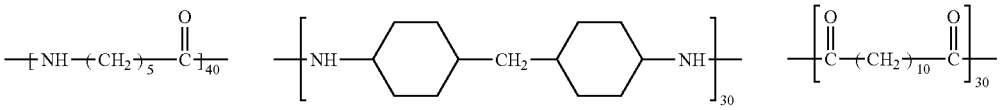

N-8

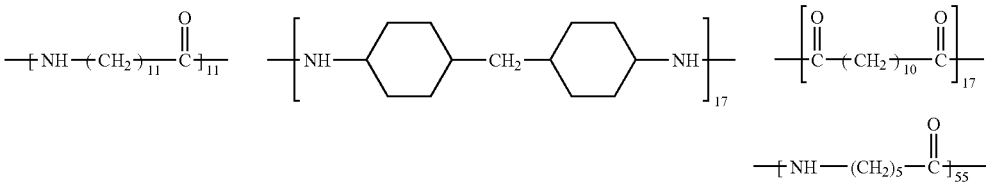

(Measurement Conditions of Water Absorption)

The weight of a measurement sample, which has been sufficiently dried, is accurately determined. Subsequently, the sample is charged into 20° C. ion-exchanged water maintained at and removed from the water after an elapse of a specific time. Water is wiped from the surface of the sample employing a clean cloth and the weight of the resultant sample is again measured. The above operation is repeated until no weight increase is noted. The increase in weight of the sample is divided by the initial weight, and the resultant value is designated as water absorption.

The organic photoreceptor to be employed in the invention is described below.

Electroconductive Substrate

Both of sheet-shaped and cylinder-shaped electroconductive substrates may be employed, and the cylindrical one is preferred for making the image forming apparatus to compact. The cylindrical electroconductive substrate is a cylindrical support by which images can be endlessly formed by the rotation of the substrate. An electroconductive substrate having a straightness of not more than 0.1 mm and a swinging of not more than 0.1 mm is preferred.

As the electroconductive material, a metal drum made from a metal such as aluminum and nickel, a plastic drum evaporated with aluminum, tin oxide or indium oxide, or a paper of plastic drum having an electroconductive substance on the surface thereof. The electroconductive supports preferably have a specific resistivity of not more than $10^3$ Ω·cm at normal temperature.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V, but not limitative. Thickness of the anodic oxidation coating is usually 20 μm or less, particularly 10 μm or less is preferable in average.

Interlayer

An interlayer, functioning as a barrier, may be preferably provided between the electrically conductive support and the photosensitive layer.

It is preferable that the intermediate layer includes titanium oxide in the aforementioned binder resin whose absorption coefficient is small. The average particle diameter of the titanium oxide particles is preferably in the range between 10 nm and 400 nm and more preferably in the range between 15 nm and 200 nm in terms of the number-based average primary particle diameter. If the size is smaller than 10 nm the effect of preventing Moire generation in the intermediate layer is small. On the other hand, if the size exceeds 400 nm, occurrence of precipitation of the titanium oxide particles in the interlayer coating composition becomes likely, and as a result, the uniform distribution of the titanium oxide particles in the interlayer becomes poor, and also an increase in black spotting is likely to occur. The interlayer coating composition using titanium oxide particles for which number-based average primary particle diameter is in the range defined above is favorable, and the interlayer that is formed from this type of coating composition functions to prevent the generation of black spotting, and in addition, is favorable in terms of environmental properties and its resistance to cracking.

The titanium oxide particles employed in the interlayer may have a dendrite, needle shape, or granular shape, and the titanium oxide particles having these shapes may for example be a crystalline type such as an anatase type, a rutile type or an amorphous type for the titanium oxide crystal. Any of the crystal types may be used, and two or more of the crystal types may be mixed and used. Among these, the rutile type and the granular shape are most favorable.

It is preferable that the titanium oxide particles are subjected to surface treatment, and one surface treatment involves carrying out multiple surface treatments, and the last of the multiple surface treatments is one in which a surface treatment using a reactive organic silicon compound is carried out. In addition at least one of the plurality of surface treatments is one in which surface treatment with at least one selected from alumina, silica, and zirconia is done, and it is preferable that the surface treatment using the organic silicon compound is carried out at the last step.

The alumina treatment, the silica treatment and the zirconia treatment are each the treatment for depositing alumina, silica and zirconia on the surface of the titanium oxide, respectively. The alumina, silica and zirconia deposited onto the surface each include the hydrated compound thereof, respectively. The surface treatment by the reactive organic silicon compound is a treatment employing the reactive organic silicon compound in processing liquid.

The surface of the titanium oxide particle can be uniformly covered, i.e., processed, by two or more times of the treatments. The titanium oxide particles can be suitably dispersed in the interlayer and the good photoreceptor not causing image defect such as the black spots can be obtained by the use of such the treated titanium oxide particles in the interlayer.

Examples of the reactive organic silicon compound are ones represented by the following Formula (1). The compound is not limited to the followings as long as the compound is capable of condensing reacting with the reactive group at the surface of titanium oxide such as a hydroxyl group.

$$(R)_n—Si—(X)_{n-n} \qquad \text{Formula (1)}$$

In the above formula, Si is a silicon atom, R is an organic group directly bonded to the silicon atom, X is a hydrolysable group and n is an integer of from 0 to 3.

Examples of the organic group represented by R which is directly bonded with the silicon include an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy-containing group such as a γ-glycidoxypropyl group and a β-(3,4-epoxycyclohexyl)ethyl group; a methacryloyl-containing group or acryloyl-containing group such as a γ-acryloxypropyl group and a γ-methacryloxypropyl group, a hydroxyl-containing group such as a γ-hydroxypropyl group and a 2,3-dihydroxypropyloxypropyl group; a vinyl-containing group such as a vinyl group and a propenyl group; a mercapto-containing group such as a γ-mercaptopropyl group; an amino-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; a nitro- or cyan-substituted alkyl group. Examples of the hydrolyzable group represented by X include an alkoxyl group such as a methoxy group and an ethoxy group, a halogen and an acyloxy group.

The organic silicon compounds represented by Formula (1) may be employed singly or in a combination of two or more kinds thereof.

In the organic silicon compound represented by Formula (1), plural groups each represented by R may be the same as or different from each other when n is 2 or more. Plural groups represented by X may be the same as or different from each other when n is 2 or more. When two or more kinds of the organic silicon compounds represented by Formula (1) are employed, groups each represented by R and X of the individual compounds may be the same as or different from each other.

Polysiloxane compounds are preferable as the reactive organic silicone compound. As such the compound, one having a molecular weight of from 1,000 to 20,000 is easily available and displays suitable black spot preventing effect.

A good effect is particularly obtained to use a methylhydrogenpolysiloxane in the last surface treatment.

Photosensitive Layer

The photosensitive layer is preferably a layer in which the function of the light sensitive layer is partially charged to the charge generation layer (CGL) and the charge transfer layer (CTL), even though the layer may be a single layer provided on the interlayer, which has both of the charge generation function and the charge transfer function. By the function separated structure, the increasing of the remaining potential accompanied with the repeating use can be reduced and the electrophotographic properties can be easily controlled for fitting the purpose. In the photoreceptor to be negatively charged, it is preferred that the charge generation layer CGL is provided on the interlayer and the charge transfer layer CTL is provided on the charge generation layer. In the photoreceptor to be positively charged, CTL and CGL are provided in this order on the interlayer. In the invention, the function separated type negatively charging photoreceptor is most preferred, in which CGL and CTL are provided on the interlayer in this order.

Each of the photosensitive layers of the function separated type negative charging photoreceptor is described below.

Charge Generation Layer

The charge generation layer contains the charge generation material CGM. The layer may be further contains a binder resin and another additive.

As the charge generation material, for example, a phthalocyanine pigment, an azo pigment, a perylene pigment or an azulenium pigment is usable singly or in combination.

A known resin can be employed in the charge generation layer as the binder when a binder is used as the dispersing medium of the CGM. The most preferable resin usable as the binder is formal resins, butyral resins, silicone resins, silicone-modified butyral resins, and phenoxy resins. The remaining potential accompanied with repeating use can be made minimum, sufficient sensitivity can be obtained, the remaining potential can be stabilized and the occurrence of the dielectric breakdown and the black spots can be inhibited by the use of such the resins. The ratio of the charge generation material to the binder is preferably from 20 to 600 parts by weight to 100 parts by weight of the binder resin. The thickness of the charge generation layer is preferably from 0.01 μm to 2 μm.

Charge Transfer Layer

The charge transfer layer contains a charge transfer material (CTM) and binder to disperse the CTM and form a film. The other substances such as an anti-oxidation agent may be incorporated.

As the charge transfer material, for example, triphenylamine derivatives, hydrazone compounds, benzidine compounds and butadiene compounds can be employed solely or in combination. These charge transfer materials are usually dissolved in a suitable binder for the layer formation. Among these, CTMs which can minimize increase in residual electric potential due to repeated use have a high mobility and a characteristic that the ionization potential difference from that of a CGM to be combined is not greater than 0.5 eV, and preferably not greater than 0.30 eV.

The ionization potential of the CTM and CGM can be measured by employing a surface analyzer AC-1 manufactured by Riken Keiki Co., Ltd.

Resins employable in the charge transfer layer (CTL) are, any of thermoplastic resin or thermosetting resin. For example, examples are mentioned as polystyrene, acryl resins, methacryl resins, vinyl chloride resins, vinyl acetate resins, polyvinyl butyral resins, epoxy resins, polyurethane resins, phenol resins, polyester resins, alkyd resins, polycarbonate resins, silicone resins, melamine resins and copolymers containing two or more structural repeating units of the foregoing resins. Other than the above insulating resin, organic semi-conductive polymers such as poly-N-vinylcarbazole are usable.

The polycarbonate resins are most preferable as the binder of the CTL since the polycarbonate resins have low water absorbing ratio and show suitable dispersing ability to the CTM and improve the electrophotographic properties.

The ratio of the charge transfer material to the binder resin is preferably from 10 to 200 parts by weight to 100 parts by weight of the binder resin. The thickness of the charge transfer layer is preferably from 10 to 40 μm.

Surface Layer

The surface layer containing the inorganic minute particles is employed for the surface layer. It is preferable endow charge transfer characteristics by containing a charge transfer material in the surface layer. The most preferable arrangement is that surface layer is the uppermost layer among the plural charge transfer layers.

The most preferable layer constitution of the photosensitive layer is exemplified in the above-mentioned, even though another constitution may also be utilized.

The followings are usable as the solvent or the dispersing medium for formation of the layers such as a photosensitive layer, a protective layer, a surface layer: n-butylamine, diethylamine, ethylenediamine, iso-propanolamine, triethanolamine, triethylenediamine, N,N-dimethylformamide, acetone, methyl ethyl ketone, methyl iso-propyl ketone, cyclohexanone, benzene, toluene, xylene, chloroform, dichloromethane, 1,2-dichloroethane, 1,2-dichloropropane, 1,1,2-trichloroethane, 1,1,1-trichloroethnae, trichloroethylene, tetrachloroethane, tetrahydrofuran, dioxolan, dioxane, methanol, ethanol, butanol, iso-propanol, ethylacetate, butyl acetate, dimethylsulfoxide and methyl cellosolve. Among them, dichloromethane, 1,2-dichloroethane and methyl ethyl ketone are preferably employed. These solvents may be employed singly or in a state of mixed solvent of two or more kinds thereof.

As a coating method for manufacturing an organic electrophotographic photoreceptor, there are used coating methods for immersion coating, spray coating and coating of a circular amount control type, however, it is preferable to use the coating method for spray coating or for coating of a circular amount control type (represented by a circular slide hopper type) so that a membrane of a lower layer may not be dissolved to the utmost by the coating operation for the upper layer in the photosensitive layer and uniform coating may be attained. Further, for the protective layer, it is preferable to use a coating method of a circular amount control type. The coating method of a circular amount control type is described in detail in, for example, JP-A No. 58-189061.

<<Toner Employed in the Present Invention>>

Toner is one which exhibits a glass transition temperature of 20-40° C., more preferably 30-40° C., and an interfacial adhesion force (Fr) to PTFE of 1.0-3.5 N, and preferably 1.5-3.0 N.

Interfacial adhesion force (Fr) between toner and PTFE, as described herein, refers to the force which is determined when a fused toner is adhered onto a member which has been subjected to surface coating employing PTFE and the resulting member is peeled from the toner.

When the interfacial adhesion force is within the range described in the claim, it is possible to enhance the strength for pulling the toner of a Tg of a relatively lower temperature of 20-40° C., whereby it is possible to realize minimization of filming of the toner to the photoreceptor, enhancement of transferability from the intermediate transfer body to the image carrier, and minimization of offsetting of toner images on the image carrying body.

Measurement of Glass Transition Point

The glass transition point of the toner can be measured by employing, for example, "DSC-7 DIFFERENTIAL CALORIMETER" (produced by Perkin Elmer Corp.) or "TAC7/DX THERMAL ANALYSIS UNIT CONTROLLER" (produced by Perkin Elmer Corp.).

In practice, about 4.00 mg of releasing agents was collected and its weight was determined down to an accuracy of two decimal places. The resultant sample was sealed in an aluminum pan (KIT No. 0219-0041) and placed in a DSC-7 sample holder. An empty aluminum pan was employed for the reference measurement. The measurement was conducted with heat-cool-heat temperature control, in which the conditions are: a measurement temperature of 0-200° C., a temperature rising rate of 10° C./minute, and a temperature cooling rate of 10° C./minute, and analysis was carried out based on data during the 2nd heating.

The glass transition temperature is obtained as follows. An extension of the base line prior to elevation of the first endothermic peak and a tangential line, which exhibits the maximum inclination between the first peak elevation position and the peak top, are drawn and the resulting intersection is regarded as the glass transition point.

(Measurement of Interfacial Adhesion Force)

FIG. 1 is a schematic view showing one example of a measurement instrument for interfacial adhesion force (Fr) and interior aggregation force (Ft).

In FIG. 1, numeral 11 represents an ascent and descent axis, 12 represents a load cell, 13 represents an insulating member, 14 represents a heating member (being a panel heater), 15 represents a head portion, 17 represents a holding member, 18 represents a toner pellet, 19 represents a contacting surface, 20 represents a furnishing member, 21 represents a spring, 22 represents a base stand, 23 represents a data input device, and 24 represents a data analyzing unit.

<<Interfacial Adhesion Force>>

Figure 2:
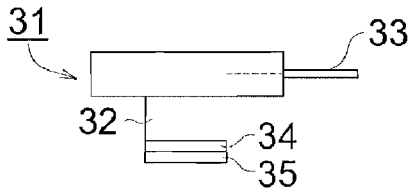
FIG. 2 is a schematic view of the head which measures interfacial adhesion force (Fr).

The interfacial adhesion force was determined by providing head portion 15 shown in FIG. 1 with the head portion shown in FIG. 2.

FIG. 2 is a schematic view of the head used for determining interfacial adhesion force (Fr).

In FIG. 2, numeral 31 represents a head portion for measuring Fr, 32 represents a cylindrical head, 33 represents a thermocoupler, 34 represents heat resistant double-sided adhesive tape, and 35 represents a PTFE coated member.

Figure 3:
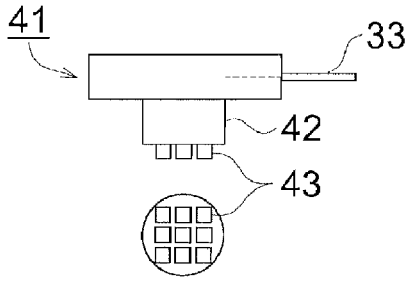
FIG. 3 is a schematic view of the head which measures inner aggregation force (Ft).

FIG. 3 is a schematic view of the head which measures inner aggregation force (Ft). In FIG. 3, numeral 41 represents a head portion for measuring Ft, 42 represents a cylindrical head, and 43 represents a head having nine points.

The measurement instrument is, for example, composed of the toner pellet fixing member as shown in FIG. 1, a pulling and pressing member (being a head), and controlling units which control pressure and temperature, and is analogous to a tensile strength tester or an extension viscometer.

Toner to be measured is subjected to press molding in the form of a pellet. Since the toner pellet is deformed during pressing, the upper surface and the lower surface are not secured to be parallel, whereby the pellet is pressed up from the bottom so that the upper surface of the toner pellet is brought into contact with the standard plane of the instrument. Further, since a pressure sensor (being a load cell) is not highly resistant to heat, a 3-stage insulation means was provided. A panel heater was employed to heat the head and the temperature was controlled employing a thermocouple arranged in the interior of the head.

In preparation of measurements, initially, a PTFE coated member was adhered to the cylindrical head (composed of aluminum A5052, at a diameter of 8 mm) employing a heat resident double-sided adhesive tape. Subsequently, a heating member (such as a panel heater) was interposed to the screw portion arranged in the insulation material and the above head was fixed via screwing. A thermocouple was inserted into the bottom of the hole provided in the head portion. Subsequently, temperature controller "E5CN-RTC" (produced by OMRON Corp.) was turned on and the temperature was set to the measurement temperature. Prior to measurement, the PTFE surface was wiped off employing tetrahydrofuran, and the toner pellet was then positioned. The toner pellet was prepared in such a manner that 2 g of toner which had been allowed to stand at 24±1° C. and relative humidity of 50±5% for 24 hours was placed in a 5 mm circular vinyl chloride ring and compressed at a pressure 150 kg for 10 seconds employing a powder press.

When reaching the predetermined temperature, measurements were initiated under the following conditions, and the maximized voltage was read and the numerical value in terms of pressure was designated as the interfacial adhesion force.

Head descending rate: 1 mm/second

Head pressing pressure: 0.1 N

Head pressure maintaining period: 1 second

Head elevating rate: 50 mm/second

Measurement ambience: 24±1° C. and 50±5% relative humidity

The interfacial adhesion force was determined at each of three measurement temperatures of 160° C., 170° C., and 180° C., and the average value was regarded as interfacial adhesion force (Fr). The interfacial adhesion force may be regulated depending on wax type, wax amount, the composition and molecular weight design of binding resins constituting the toner, and the structural design of the interior of the toner. Of these, the composition and molecular weight design of binding resins constituting the toner, and the structural design of the interior of the toner particle are important factors.

Structural design of the interior of the toner particle, as described herein, refers to the manner in which resins which differ in characteristics are located in the interior of the toner particle and further, the design of the existing state. For example, it may be possible to consider methods in which resin particles which exhibit a higher glass transition temperature than that of the entire toner are located near the surface of the toner particle to result in a core/shell structure, and resins at a relatively high Tg are located in a dispersed state in the interior of the toner particle.

Toner production methods are not particularly limited as long as toner at a glass transition temperature of 20-40° C., and at an interfacial adhesion force between the toner particle and PTFE of 1.0-3.5 N is produced. Listed as production methods may, for example, be a suspension polymerization method, an emulsion aggregation method, a dispersion polymerization method, a dissolution suspension method, a melting method, and a kneading pulverization method. Of these, in terms of ease of structural design of the interior of a toner particle, the emulsion coalescence method is preferably employed. In one of the embodiments, specific designing methods of the interior of a toner particle include a method in which a core/shell structure is formed in such a manner that a core particle is initially formed and adhered to a resin particles for the shell; (b) a method in which binding resins are coalesced/fused in the presence of hydrophobic resins and hydrophilic resins so that the hydrophobic resins are located in the interior of the toner particle and the hydrophilic resins are located near the surface of the toner particle, whereby a core/shell structure results; and (c) a method in which in an aggregation process of resin particles, during growth of Resin Particles A, Resin Particles B, which differ in characteristics, are added, and while further growing the resultant particles, Resin Particles B are included into Resin Particles A in a dispersed state.

An example of preparation method of toner according to the present invention by an emulsion coagulation method taking the methods of above mentioned (b) and (c).

(1) dissolution/dispersion step of dissolving and/or dispersing a releasing agent in a radical-polymerizable monomer;

(2) polymerization step of preparing a dispersion of resin particles A containing hydrophilic resin and hydrophobic resin;

(3) coagulation step of allowing resin particle and colorant particles to be coagulated to obtain coagulated particles;

(4) coagulation step of fusing as well as ripening the coagulated particles with heat energy, and orientating a hydrophilic resin to a surface and a hydrophobic resin to interior of the toner original to prepare a toner origin having a core/shell structure as well as adding resin particles B during a growing process of resin particles A, and completing after continuing coagulation;

(5) the step of fusing coagulated particles with heat energy to obtain a dispersion of toner origin (associated particles);

(6) the step of cooling the dispersion of toner origin;

(7) washing step of solid-liquid separating the toner origin from dispersion of toner origin to remove a surfactant and the like from the toner origin;

(8) drying step of the washed toner origin; and (9) the step of adding external additives to the dried colored particles.

Each of the processes is described in detail.

(Dissolution/Dispersion Process)

In the above process, releasing agents are dissolved in or dispersed into radically polymerizable monomers and a radically polymerizable monomer liquid of the aforesaid releasing agents is prepared.

(Polymerization Process)

In an appropriate example of the above polymerization process, the above radically polymerizable monomer solution incorporating the above dissolved or dispersed releasing agents is added to a water based medium incorporating surface active agents, followed by formation of liquid droplets via application of mechanical energy. Subsequently, a polymerization reaction is allowed to proceed in the resulting liquid droplets via radicals generated from water-soluble radical polymerization initiators. Further, in the above water based medium, resin particles may be added as a nucleus particle or the polymerization reaction may be performed stepwise.

Based on the above polymerization process, obtained are resin particles incorporating releasing agents, hydrophilic resins, and hydrophobic resins. Such resin particles may be colored. Colored resin particles are prepared via polymerization of a monomer composition incorporating colorants. On the other hand, when non-colored resin particles are employed, it is possible to prepare a toner origin in such a manner that in the melting process described below, a colorant particle dispersion is added to the resin particle dispersion so that the resin particles and the colorant particles are molten together.

(Aggregation/Fusion Process)

Charged into water, in which resin particles, and if desired, colorant particles are present, are salting-out agents composed of alkali metal salts or alkali earth metal salts as an aggregating agent at a concentration of higher than the critical aggregation concentration. Further, in the above aggregation process, it is possible to aggregate internal additive particles, such as releasing agent particles, charge controlling agent particles, or resin particles which differ in thermal characteristics, together with the resin particles and colorant particles.

Specifically, aggregation of Resin Particles A is initiated, followed by the particle growth to the targeted diameter. For example, when toner particles at a median diameter ($D_{50}$) of 6 μm in terms of a volume standard, aggregation is allowed until the particle diameter of Aggregated Particles A reaches 30-70% of the targeted toner particle diameter. In the above stage, Resin Particles B dispersion is added. It is preferable to control the addition amount of Resin Particles B to 10-80% by weight with respect to Resin Particles A.

After adding the Resin Particles B dispersion, further aggregation is allowed, whereby particle growth reaches the final particle diameter. After aggregation, Resin Particles B are included in the aggregation of Resin Particles A.

In the above process, when both hydrophilic resins and hydrophobic resins are present in Resin Particles A, the hydrophilic resins are located on the surface of the particle, while hydrophobic resins are located in the interior, whereby it is possible to form a toner origin having the core/shell structure.

(Ripening Process)

In the ripening process, as described herein, the shape of the above aggregated/fused toner particle is modified to the targeted circularity. It is preferable to carry out such ripening via a thermal process (heating).

(Cooling Process)

In the above process, the dispersion of the above toner origin is cooled. A cooling condition is such that cooling is carried out at a cooling rate of 1-20° C./minute. Cooling methods are not particularly limited and include a method in which cooling is carried out via introduction of coolants from the exterior of the reaction vessel and a method in which cold water is directly charged into a reaction system.

(Solid-Liquid Separation/Washing Process)

In this solid-liquid separation/washing process, a solid-liquid separation in which the aforesaid toner origin is subjected to solid liquid separation of the aforesaid toner origin dispersion cooled to a specified temperature in the above process and washing in which added materials such as surface active agents or salting-out agents are removed from a solid-liquid separated toner cake (an assembly which forms by aggregating the toner origin in a wet state to a cake) is performed. Filtration methods, as described herein, are not particularly limited and include a centrifugal separation method, a reduced pressure filtration method employing a Buchner funnel, and a filtration method employing a filter press.

<Drying Process>

The drying process is one in which said washed toner cake is subjected to drying processing and obtain a dried toner origin. Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed. It is proposed that the moisture content of dried toner origin is preferably not more than 5 percent by weight, and is more preferably not more than 2 percent by weight. Aggregates may be subjected to crushing treatment when dried toner origin particles are aggregated due to weak attractive forces among particles. Herein, employed as crushing devices may be mechanical a crushing devices such as a jet mill, a Henschel mixer, a coffee mill, a food processor, and the like.

<Adding Process of External Additive>

An external additive is mixed with the dried toner origin according to necessity to prepare a toner in this process. A mixing apparatus such as a Henschel mixer, a coffee mill and so on may be used for the apparatus for mixing the external additive.

The compounds composing toner such as a binding resin, a colorant, a releasing agent, a charge controller, and an external additive, are described.

<Binding Resin>

Known compounds may be used for polymerization monomers forming Resin Particle A and Resin Particle B composing the binding resin. It is preferable to use styrene or acryl acid derivative or methacrylic acid derivative in combination with one having an ionic dissociation group concretely.

Polymerizing monomers utilized to compose resin include styrenes or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylamino methacrylate and dimethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; vinyl halogenides such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinylmethyl ether and vinylethyl ether; vinyl ketones such as vinylmethyl ketone, vinylethyl ketone and vinylhexyl ketone; N-vinyl compounds such as N-vinylcarbazole, N-vinylindole and N-vinylpyrrolidone; vinyl compounds such as vinylnaphthalene and vinylpyridine; and acrylic acid or methacrylic acid derivatives such as acrylonitrile and acrylamide. These vinyl type monomers can be utilized alone or in combination.

Further, it is more preferable to use combination of those provided with an ionic dissociation group as a polymerizing monomer composing resin. The examples include those having a substituent such as a carboxyl group, a sulfonic acid group or phosphoric acid group as a constituent groups of the monomer, and specifically, such as acrylic acid, methacrylic acid, maleic acid, styrenesulfonic acid, allylsulfosuccinic acid, 2-acrylamido-2-methylpropanesulfonic acid, acid phosphoxy ethylmethacrylate and 3-chloro-2-acid phosphoxy propylmethacrylate).

Further, resins having cross-linking structures can be prepared by utilizing multi-functional vinyls such as divinylbenzene, ethyleneglycol dimethacrylate, ethyleneglycol diacrylate, diethylene glycol dimethacrylate, diethylene glycol diacrylate, triethylene glycol dimethacrylate, triethylene glycol diacrylate, neopentylglycol dimethacrylate and neopentylglycol diacrylate.

These polymerizing monomers can be polymerized by utilizing a radial polymerization initiator. An oil-soluble polymerization initiator can be utilized in a suspension polymerization method in this case. The oil-soluble polymerization initiators include an azo type or diazo type initiators such as 2,2'-azobis-(2,4-dimethylvaleronitrile), 2,2'-azobis-isobutyronitrile, 1,1'-azobis(cyclohexane-1-carbonitrile), 2,2'-azobis-4-methoxy-2,4-dimethylvaleronitrile and azobisisobutyronitrile; peroxide compound type polymerization initiators or polymer initiators provided with a peroxide in the side chain such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butyl peroxycyclohexyl)propane and tris-(t-butyl peroxy)triazine.

Further, in the case of employing an emulsion polymerization method, a water-soluble radical polymerization initiator can be utilized. Water-soluble polymerization initiators include persulfate salts such as potassium persulfate and ammonium persulfate, azobisamino dipropane acetate, azobiscyanovaleric acid and salts thereof, and hydrogen peroxide.

It is preferable that polymerizable monomers which give higher glass transition point than that of the resin particle A for forming resin particle B.

<Colorant>

Listed as usable colorants may be inorganic or organic colorants. Specific colorants are listed below.

Employed as black colorants are, for example, carbon black such as furnace black, channel black, acetylene black, thermal black, lamp black, and the like, and in addition, magnetic powders such as magnetite, ferrite, and the like.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 74, C.I. Pigment Yellow 93, C.I. Pigment Yellow 94, C.I. Pigment Yellow 138, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Blue 62, C.I. Pigment Blue 66, C.I. Pigment Green 7, and the like.

If desired, these colorants may be employed individually or two or more in combination of selected ones. The added amount of pigments is commonly between 1 and 30 percent by weight, and is preferably between 2 and 20 percent by weight.

<Releasing Agent>

A releasing agent may be used as the toner.

Examples of these compounds include polyolefin wax such as polyethylene wax or polypropylene wax; long chain hydrocarbon wax such as paraffin wax or SAZOL wax; dialkyl ketone wax such as distearyl ketone; ester wax such as carnauba wax, montan wax, trimethylolpropane tribehenate, pentaerythritol tetrabehenate, pentaerythritol diacetate dibehenate, glycerin tribehenate, 1,18-octadecanediole distearate, tristearyl trimellitate, or distearylmaleate; and amide wax such as ethylenediamine behenyl amide, or trimellitic acid tristearyl amide.

The amount of a releasing agent contained in toner is preferably 1-20% by weight, based on the total amount of toner and more preferably 3-15% by weight.

<Charge Control Agent>

A charge control agent may be added to the toner according to the present invention. The charge control agent conventionally known in the art may be used.

<External Additive>

Employable fine inorganic minute particles as the external additives may be those conventionally known in the art. Specifically, it is possible to preferably employ fine silica, titanium, and alumina particles and the like. These fine inorganic minute particles are preferably hydrophobic.

The employable fine organic particles as the external additives are fine spherical organic particles having a number average primary particle diameter of 10 to 2,000 nm. Employed as such particles may be of polystyrene or polymethyl methacrylate, or styrene-methyl methacrylate copolymers.

<Surface Energy Lowering Agent>

A surface energy lowering agent is not particularly restricted as far as it increases the contact angle (contact angle with respect to deionized water) of the surface of the photoreceptor in a degree equal to or greater than 1 degree by adhering to the surface, and preferable examples are metal salt of the aliphatic acid or fluorine resin.

The surface energy lowering agent may be added by such a method to add inside of toner particle or outside of toner particle as an external additive in case it is added to a toner to provide it to the surface of the photoreceptor. It is preferable to add as an external additive in view of the purpose of providing it to the photoreceptor. Preferable amount to add is 0.005-0.3 percent by weight, and more preferably 0.01-0.2 percent by weight.

The surface energy lowering agent may be provided to the surface of the photoreceptor via a surface energy lowering agent providing member.

As a surface energy lowering agent to be applied on the surface of a photoreceptor, fatty acid metal salt is most preferable because of extendibility on the surface of a photoreceptor and performance of forming a uniform layer. As for the fatty acid metal salt, saturated or unsaturated fatty acid metal salt having carbon number of 10 or more is preferable. For example, aluminum stearate, indium stearate, gallium stearate, zinc stearate, lithium stearate, magnesium stearate, sodium stearate, aluminum palmitate, aluminum oleate may be usable. More preferably, metal stearate may be usable.

Among the above fatty acid metal salt, fatty acid metal salt with a particularly high outflow rate measured by a flow tester is highly cleavage and capable of effectively forming a layer of fatty acid metal salt on the surface of a photoreceptor. The outflow rate is preferably in the range from $1\times10^{-7}$ to $1\times10^{-1}$ (ml/sec), and most preferably from $5\times10^{-4}$ to $1\times10^{-2}$ (ml/sec). The outflow rate was measured employing Shimadzu Flowtester "CFT-500" (manufactured by Shimadzu Corporation).

For other examples of solid material are powder of fluorinated resin, such as, polyvinylidene fluoride, polytetrafluoroethylene and so on are preferable. The solid material is used in a shape of a plate or rod by applying stress if necessarily.

<Measurement of Contact Angle and its Fluctuation>

The contact angle is a contact angle with respect to deionized water to surface of the photoreceptor, and is measured with a contact angle meter (model CA-DT·A, manufactured by Kyowa Interface Science Co., Ltd.) in an environment of 30° C. and RH 80%.

Any fluctuation of the contact angle is determined at 30° C. and 80% relative humidity. The measurement is carried out when the photoreceptor gets to fit image formation and surface energy lowering agents are sufficiently provided onto the surface of the photoreceptor (after images are repeatedly formed on at least 1,000 sheets). Measurements are carried out at a total of 12 positions including 3 near the center and 3 cm from both edges for each of 90° in the circumference direction. The average value is regarded as the contact angle, while the value which results in the maximum deviation from the resultant average in terms of positive or negative was regarded as the fluctuation value.

Fluctuation of the contact angle to the above photoreceptor is preferably within ±5°, is more preferably within ±4°, but is most preferably within ±3° in view of forming a preferable image having uniform halftone with minimized center lower density or toner dots near characters.

The components of the energy lowering agent tend to result in excessive moisture content at high temperature and high humidity due to the presence of hydrophilic groups and impurities in the components. As the moisture content increases, the above surface energy lowering agents are not uniformly spread across the surface of the photoreceptor, whereby it is not possible to allow the effects of the present invention to be sufficiently exhibited. It is preferable that the moisture content of the surface energy lowering agents employed in the present invention is at most 5.0% by weight under high temperature and high humidity conditions of 30° C. and 80% relative humidity. When the moisture content is at most 5.0% by weight, the surface energy lowering agents are spread uniformly, whereby it is possible to sufficiently exhibit the effects of the present invention.

Measurement of the water content ratio of the surface energy lowering agent can be performed after leaving the material for 24 hours at a temperature of 30° C. and RH 80% and then the material is put into a laboratory dish, with Karl Fischer Moisture Titrator (model MKA-3p manufactured by Kyoto Electronics Manufacturing Co., Ltd.).

Adjustment of the water content ratio of the surface energy lowering agent not greater than 5.0 wt % can be achieved by control of hydrophilic components and impurities in the material such as refining, hydrophobic processing, and decreasing of water content amount under a high temperature and humidity (30° C. and RH 80%) as well as mixing of water content adjusting agent, high temperature drying, and the like. With a large amount of the water content, it is difficult to uniformly extend the surface energy lowering agent on the surface of the photoreceptor, and the effects of the invention cannot be realized sufficiently. The water content ratio is preferably from 0.01 to 5.0 wt % and more preferably from 0.05 to 3.0 wt %, because the effects of the invention are hardly affected by an environmental change due to temperature rise or the like during copying, particularly by humidity at the place of the image carrier, and selection of material and hydrophobic treatment are easy and hollow defects and character blurring due to easily varying contact angle at the surface of the photoreceptor are restrained as the surface energy lowering agent is extended uniformly to the surface of the photoreceptor.

<Developer>

The toner may be used as a single- or dual-component developer.

A non-magnetic single-component developer and a magnetic single-component developer containing magnetic particles having 0.1-0.5 mm in the toner may be mentioned and both are employed.

The toner may be employed as a two-component developer by blending with a carrier. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 20 to 100 μm, and is more preferably 25 to 80 μm.

The volume average particle diameter of said carrier can be representatively measured employing a laser diffraction type particle diameter distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin for coating is not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like. The coated carrier having coated with styrene-acryl resin is preferable because it maintains prevention of releasing external additive or durability.

The image is formed by a method that the latent image on the photoreceptor is developed in the presence of the surface energy lowering agent. A developer may contain the surface energy lowering agent, or the surface energy lowering agent may be provided via a providing member so that the developing is conducted in the presence of the surface energy lowering agent. The surface energy lowering agent is preferably a metal salt of aliphatic acid.

<Measuring Method of Toner Particle Diameter>

Measuring Volume Based Median Diameter (Volume D50% Diameter) of the Toner

The measurement and calculation is conducted by using a device composed of a Coulter Multisizer II (manufactured by Beckman Coulter, Inc.) connected to a data processing computer system (manufactured by Beckman Coulter, Inc.).

The measuring procedure is that toner of 0.02 g is allowed to become accustomed to a surface-active agent of 20 ml (for the purpose of dispersion of toner, for example, a surface-active agent solution in which a neutral detergent including a surface-active agent component is diluted to 10 times in pure water) and then is subject to ultrasonic dispersion for one minute, thus a toner dispersed liquid is prepared. The toner dispersion liquid is injected into a beaker containing ISOTON II (manufactured by Beckman Coulter, Inc.) in the sample stand up to measurement density of 5% to 10% by a pipette and the particle diameter is measured by setting the count of a measuring instrument to 25,000. Further, the aperture diameter of the Coulter Multisizer is 50 μm.

The shape of the toner particles will be described. Measurement is carried out for at least 2,000 toner particles at a diameter of at least 1 μm. The average value of circularity (being a shape factor) represented by the following formula is commonly 0.95-0.99, but is preferably 0.94-0.97.

$$\text{Circularity}=(\text{peripheral length of equivalent circle})/(\text{peripheral length of projective image of the toner particle})-2\pi\times(\text{projective area of particle}/\pi)^{1/2}/(\text{peripheral length of projective image of the toner particle})$$

"Equivalent circle", as described herein, refers to a circle which has the same area as that of the projective image of the toner particle, and "circle equivalent diameter" refers to the diameter of the above equivalent circle.

It is possible to determine the above circularity employing FPIA-2000 (produced by Sysmex Co.). In this case, the circle equivalent diameter is defined via the following formula.

$$\text{Circle equivalent diameter}=2\times(\text{projective area of particle}/\pi)^{1/2}$$

<Image Forming Method of the Present Invention>

The image forming apparatus using the toner of the present is not particularly restricted, but a preferable apparatus is that employing contact fixing means for thermally fixing toner image formed on a transfer material by passing between heating parts composing the fixing device.

<Image Forming Method of the Present Invention>

The image forming apparatus and the fixing device preferably used in the present invention is described.

Figure 4:
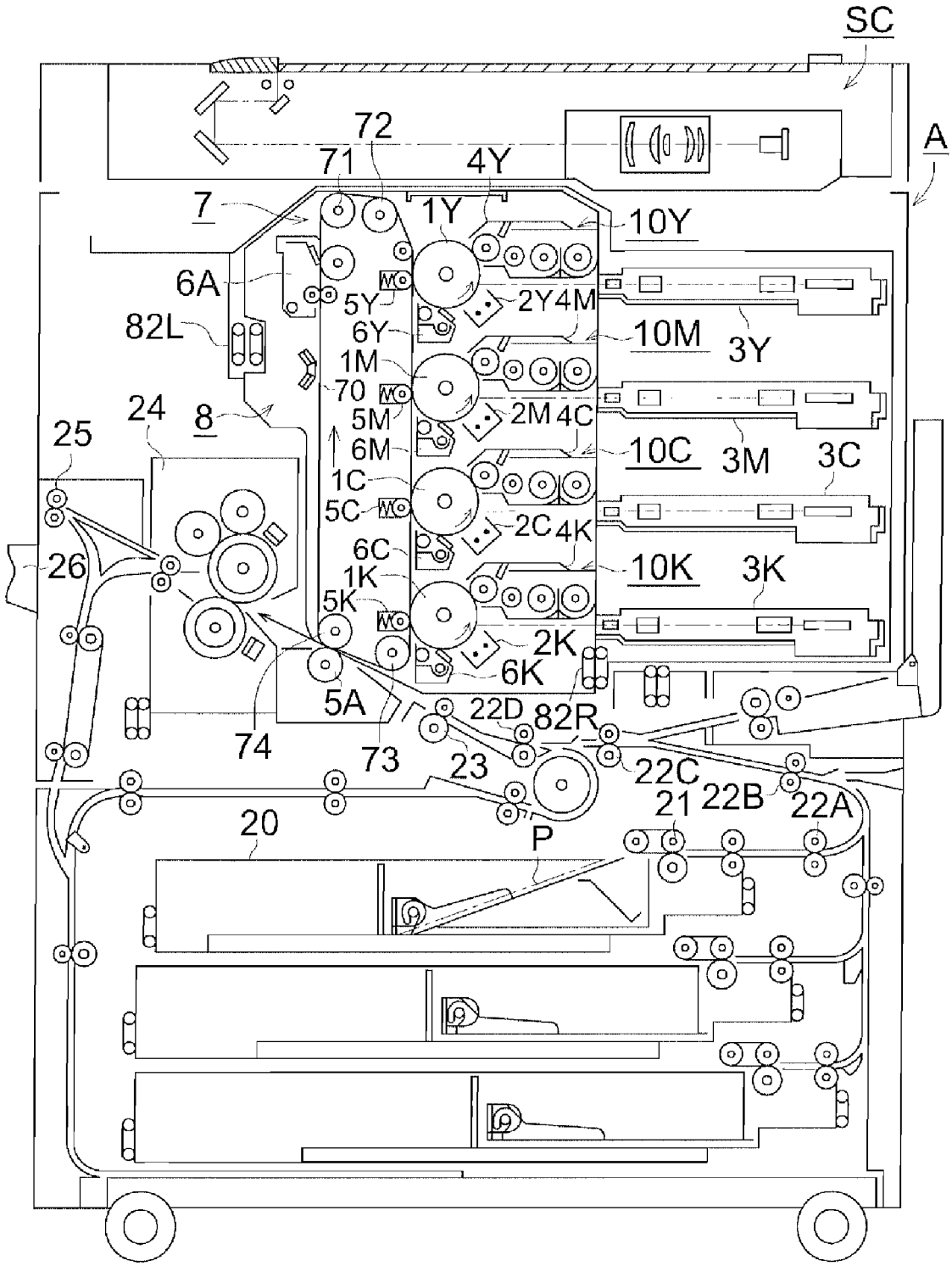
FIG. 4 is a sectional structural view of an image forming apparatus showing one embodiment of the present invention.

FIG. 4 is a cross-sectional construction diagram of a color image forming apparatus, showing an embodiment of the invention.

This color image forming apparatus is called a tandem type color image forming apparatus and is comprised of a set of plurality of image forming sections 10Y, 10M, 10C, and 10K, endless-belt shape intermediate transfer unit 7, sheet convey device 21, and fixing device 24. Document image reading device SC is arranged on body A of the image forming apparatus.

The image forming section 10Y that forms yellow images is comprised of charging device 2Y, exposure device 3Y, developing device 4Y, primary transfer roller 5Y as primary transfer means, and cleaning device 6Y, which are arranged around drum shape photoreceptor 1Y as a first image carrier. The image forming section 10M that forms magenta images is comprised of drum shape photoreceptor 1M as a first image carrier, charging device 2M, exposure device 3M, developing device 4M, primary transfer roller 5M as primary transfer means, and cleaning device 6M. The image forming section 10C that forms cyan images is comprised of drum shape photoreceptor 1C as a first image carrier, charging device 2C, exposure device 3C, developing device 4C, primary transfer roller 5C as primary transfer means, and cleaning device 6C. The image forming section 10K that forms black images is comprised of drum shape photoreceptor 1K as a first image carrier, charging device 2K, exposure device 3K, developing device 4K, primary transfer roller 5K as primary transfer means, and cleaning device 6K.

The endless-belt shape intermediate transfer unit 7 is windingly circulated by a plurality of rollers and has second endless-belt shaped intermediate transfer member 70, as a second image carrier, that is circulatively supported, semiconductive, and in an endless-belt shape.

Images in respective colors formed by the image forming sections 10Y, 10M, 10C, and 10K are sequentially transferred onto the rotating endless-belt shape intermediate transfer member 70 by the primary transfer rollers 5Y, 5M, 5C, and 5K as primary transfer means so that a composite color image is formed. Sheet P as a recording medium received in sheet feeding cassette 20 is fed by sheet feeding device 21, conveyed to secondary conveying roller 5A as secondary conveying means through a plurality of intermediate rollers 22A, 22B, 22C, 22D, and registration roller 23, and then, the color image is secondarily transferred onto the sheet P in one-shot. The sheet P on which the color image has been transferred is fixed by fixing device 24, sandwiched by exit roller 25, and mounted on exit tray 26 outside the machine.

On the other hand, after the color image has been transferred to the sheet P by the secondary transfer roller 5A as the secondary transfer means, the endless-belt type intermediate transfer member 70, from which the sheet P has self-striped, is removed of residual toner by cleaning device 6A.

During the image forming processing, the primary transfer roller 5K is all the time pressed against the photoreceptor 1K. The other primary transfer rollers 5Y, 5M, and 5C are pressed against the respective photoreceptors 1Y, 1M, and 1C only when the respective color images are formed.

The secondary roller 5A is pressed against the endless-belt shape intermediate transfer member 70 in contact therewith only when the sheet P passes through between them and the secondary transfer is carried out.

Housing 8 can be drawn out from the apparatus body A, guided by supporting rails 82L and 82R.

In the housing 8, there are arranged the image forming sections 10Y, 10M, 10C, 10K, and the endless-belt shape intermediate transfer unit 7.

The image forming sections 10Y, 10M, 10C, and 10K are disposed vertically in alignment. The endless-belt shape intermediate transfer unit 7 is disposed on the left side, in the figure, of the photoreceptors 1Y, 1M, 1C, and 1K. The endless-belt shape intermediate transfer unit 7 is comprised of the endless-belt shape intermediate transfer member 70 which is circulative and windingly rotated by the rollers 71, 72, 73, and 74, the primary transfer rollers 5Y, 5M, 5C, 5K, and the cleaning device 6A.

Image forming sections 10Y, 10M, 10C, and 10K, and looped transfer belt unit 7 are pulled out in an integral form from main body A via pulling-out operation of housing 8.

Paired rails 82L on the left side in illustrated housing 8 are arranged on the left side of looped transfer belt in the upper empty space, while paired rails 82R on the right side in illustrated housing 8 is arranged near the bottom of development means 4K in the bottom section. Paired rails 82R are arranged at a position which does not disturb loading and unloading operations of development means 4Y, 4M, 4C, and 4K within housing 8.

In the image forming method of the present invention, images may be formed while providing surface energy lowering agents onto the surface of the electrophotographic photoreceptor via an agent providing means. Namely, by continually feeding surface energy lowering agents onto the surface of the working photoreceptor during formation of electrophotographic images, it is possible to maintain a state in which the surface contact angle, and fluctuation thereof, are minimal. Further, continually feeding, as described herein, includes the following cases in which feeding is continually carried out from the initiation of image formation to termination thereof, feeding may be temporarily terminated at the initiation and the termination, or when the surface energy lowering agents are excessively fed due to a certain reason, feeding may temporarily be terminated even during actual image formation.

A case will now be described in which development is carried out in the presence of the surface energy lowering agents on the surface of the electrophotographic photoreceptor of the present invention. In one embodiment methods to feed surface energy lowering agents onto the photoreceptor may include one in which the surface energy lowering agents are blended with a developer from which they are fed onto the photoreceptor. However, when the surface energy lowering agents are blended with the developer, such blending may adversely affect development characteristics such as charging characteristics or fluidity of the toner. Further, in regard to the toner according to the present invention, effects to minimize center lower density or toner dots near characters may be insufficient. Agent providing means may be arranged at the appropriate positions around the electrophotographic photoreceptor. However, to efficiently use the installation space, the installation may be carried out partially employing the charging means, the development means, and/or the cleaning means shown in FIG. 4. An example in which the cleaning means is employed together with the agent providing means is described below.

Figure 5:
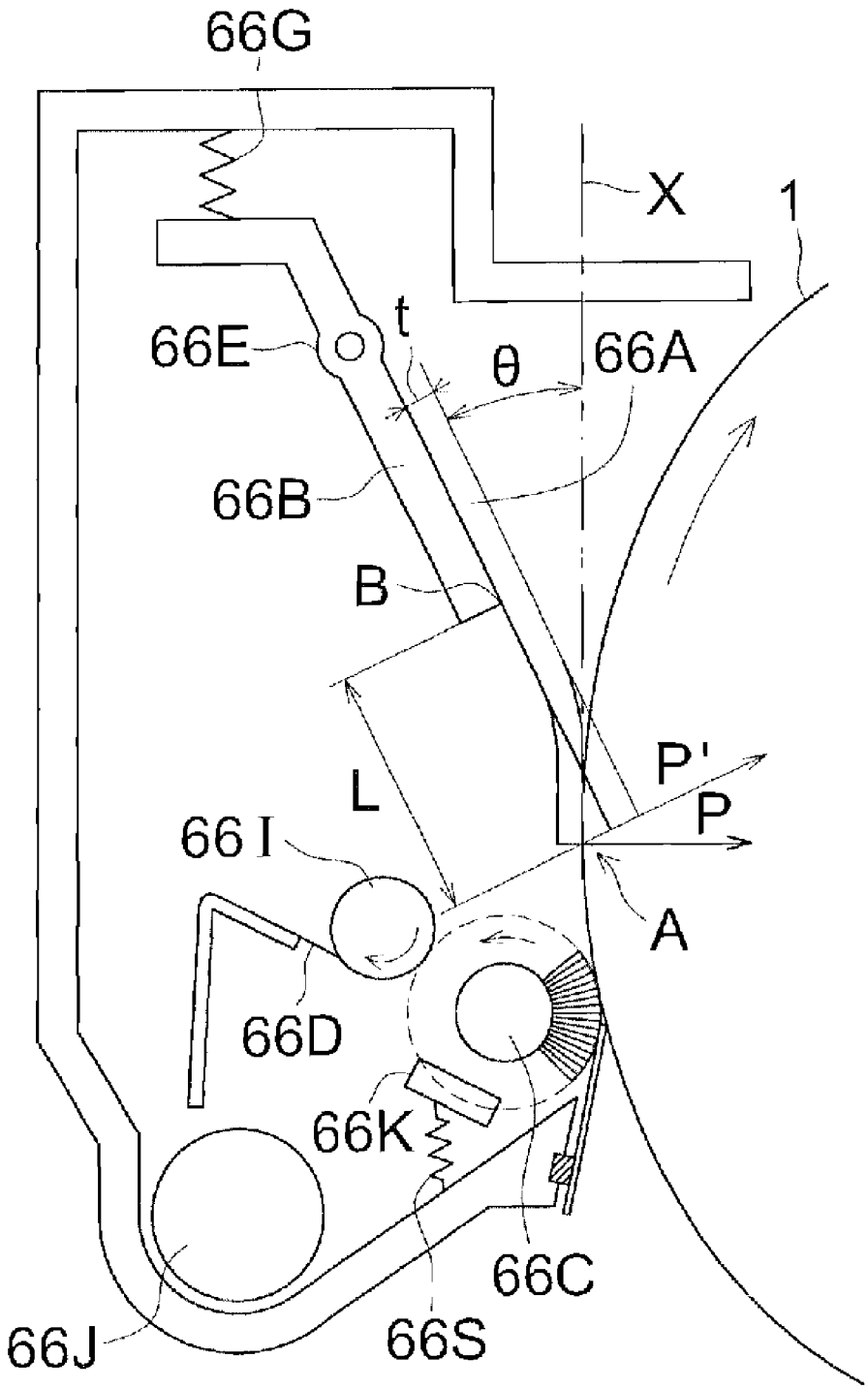
FIG. 5 is a structural view of the cleaning means housed in the photoreceptor according to the present invention.

FIG. 5 shows a schematic view of a cleaning device according to the present invention. This cleaning device is used as a cleaning device of 6Y, 6M, 6C, 6K, and the like, in FIG. 4. Cleaning blade 66A in FIG. 5 is fitted to supporting member 66B. As the material of the cleaning blade, a rubber elastic body is employed. Specifically, for the material, there are known urethane rubber, silicone rubber, fluorine rubber, chloroprene rubber, butadiene rubber, wherein urethane rubber is particularly preferable because of excellent friction characteristic compared with other rubbers. On the other hand, supporting member 66B is constructed by a plate shape metal material or plastic material. As a metal material, a stainless steel plate, aluminum plate, or an earthquake resistant steel plate is preferable.

The tip of the cleaning blade that is pressed against the surface of the photoreceptor in contact therewith is preferably pressed in the state that a load is applied in the direction (counter direction) opposite to the rotation of the photoreceptor. As shown in FIG. 5, the tip of the cleaning blade preferably forms a pressure contact plane when it contacts with the photoreceptor with pressure.

Preferable values of contact load P and contact angle θ are respectively P is 5 to 40 N/m and θ is 5 to 35 degrees.

The contact load P is a vector value, in the normal direction, of press load P' during when cleaning blade 66A is in press contact with photoreceptor drum 1.

The contact angle θ is an angle between tangent X of the photoreceptor at contact point A and the blade, shown by a dotted line, having not yet been displaced. Numeral 66E represents a rotation shaft that allows the supporting member to rotate, and 66G represents a load spring.

Free length L of the cleaning blade represents, as shown in FIG. 5, the distance between the position of edge B of the supporting member 66B and the tip point of the blade having not yet been displaced. A preferable value of the free length L is in the range from 6 to 15 mm. Thickness t of the cleaning blade is preferably in the range from 0.5 to 10 mm. The thickness of the cleaning blade herein is in the octagonal direction with respect to a surface adhering to the supporting member 66B.

Brush roll 66C is employed as the cleaning device in FIG. 5 which also serves as the agent supply device. The brush roll has functions of removing toner adhering to the photoreceptor 1 and recovering the toner removed by the cleaning blade 66A as well as a function as an agent supply device for supply of surface energy lowering agent to the photoreceptor. That is, the brush roll contacts with the photoreceptor 1, rotates in the same direction with the rotation of the photoreceptor at a contact part thereof, removes toner and paper particles on the photoreceptor, conveys toner removed by the cleaning blade 66A, and recovers the removed toner and paper particles to conveying screw 66J. Regarding the path herein, it is preferable that flicker 66I as removing means is contacted with the brush roll 66C, thereby removing the removed such as the toner which has been transferred from the photoreceptor 1 to the brush roll 66C. Further, the toner deposited to the flicker is removed by scraper 66D and recovered into the conveying screw 66J. The recovered toner is taken out outside as waste, or conveyed to a developing vessel through a recycle pipe, not shown, for recycling toner to be reused. As a material of the flicker 66I, metal pipes of stainless steel, aluminum, etc. are preferably used. As the scraper 66D, it is preferable that an elastic plate such as phosphor-bronze plate, polyethylene terephthalate board, polycarbonate plate is employed, and the tip thereof is contacted with the flicker by a counter method in which the tip forms an acute angle with respect to the rotation direction of the flicker.

Surface energy lowering agent, solid material of zinc stearate and so on, 66K is pressed by spring load 66S to be fitted to the brush roll, and the brush rubs the surface energy lowering agent while rotating to supply the surface energy lowering agent to the surface of the photoreceptor.

As the brush roll 66C, a conductive or semiconductive brush roll is employed. An arbitrary material can be used as the material of the brush of the brash roll, and, a fiber forming high molecular polymer having a high dielectric constant is preferable. As such a high molecular polymer, for example, rayon, nylon, polycarbonate, polyester, a methacrylic acid resin, acryl resin, polyvinyl chloride, polyvinylidene chloride, polypropylene, polystyrene, polyvinyl acetate, styrene-butadiene copolymer, vinylidene chloride-acrylonitrile copolymer, vinyl chloride-vinylacetate copolymer, vinyl chloride-vinyl acetate-maleic anhydride copolymer, silicone resin, silicone-alkyd resin, phenol-formaldehyde resin, styrene-alkyd resin, polyvinyl acetal, for example, polyvinylbutyral, may be usable. These high molecular polymers can be used solely or in a mixture of each other in two or more high molecular polymers. Preferably, rayon, nylon, polyester, acryl resin, polypropylene may be usable.

As the brush, a conductive or semiconductive brush is employed, wherein the brush is prepared by providing a low resistance material such as carbon into a material of the brush and adjusting the specific resistance of the material of the brush to an arbitrary value.

The specific resistance of a brush bristle of the brush roll is preferably in the range from $10^1$ to $10^6$ Ωcm when measured in the state that a voltage of 500 volts is applied to both ends of a piece of brush bristle with a length of 10 cm at a normal temperature and humidity, i.e., temperature 26° C., and humidity 50%.

The brush roll is preferably comprised of a stem of stainless steel or the like and conductive or semiconductive brush bristles having a specific resistance in the range from $10^1$ to $10^6$ Ωcm. If the specific resistance is lower than $10^1$ Ωcm, banding or the like due to electric discharge easily occurs. If the specific resistance is higher than $10^6$ Ωcm, the electrical potential difference from the photoreceptor is low, and cleaning defects easily occur.

A brush bristle for the brush roll preferably has a thickness in the range from 5 to 20 denier. If the thickness of each brush bristle is smaller than 5 denier, the brush roll cannot remove surface deposits due to an insufficient rubbing force. If the thickness of each brush bristle is larger than 20 denier, the brush scratches the surface of the photoreceptor due to stiffness and promotes abrasion, thus shortening the life of the photoreceptor.

The value in "denier" herein is the value of mass of a 9000 m long brush bristle (fiber) measured in grams, the brush bristle constructing the brush.

The density of the brush bristles of the brush is in the range from $4.5\times10^2/cm^2$ to $2.0\times10^4/cm^2$ (number of brush bristles per $cm^2$). If the density is smaller than $4.5\times10^2/cm^2$, the rubbing force is weak due to low stiffness of the bristles, and irregularities are caused in rubbing, which makes it difficult to remove deposits uniformly. If the density is larger than $2.0\times10^4/cm^2$, the photoreceptor is abraded easily by a strong rubbing force due to high stiffness of the bristles, which makes it easy to cause image defects such as fogging due to drop in sensitivity and black streaks due to scratches.

The depth of piercing of the brush roll into the photoreceptor is preferably from 0.4 to 1.5 mm. This depth of piercing is equivalent to the load caused by a relative motion between the drum of the photoreceptor and the brush roll and applied to the brush. This load corresponds to a rubbing force applied by the brush to the drum of the photoreceptor from the viewpoint thereof. Therefore, it is preferably to specify the load so that the photoreceptor is rubbed with a proper force.

This depth of piercing is defined by a length of piercing into the photoreceptor with an assumption that a brush bristle goes linearly inside the photoreceptor without curving on the surface of the photoreceptor when the brush contacts with the photoreceptor.

By setting the piercing depth equal to or longer than 0.4 mm, the rubbing force of the brush to be applied to the drum of the photoreceptor is tuned properly, thereby filming of toner, paper particles, and the like onto the surface of the photoreceptor is inhibited, and irregularities on the image are suitably inhibited. By setting the piercing depth equal to or shorter than 1.5 mm, the rubbing force of the brush to be applied to the drum of the photoreceptor is tuned properly, thereby the abrasion amount of the photoreceptor is reduced, fogging due to drop in sensitivity is prevented, and scratches on the surface of the photoreceptor and streaking defects on the image are avoided.

As the stem of a roll part to be used as a brush roll, metals such as stainless steel and aluminum, paper, plastics are mostly used, but not limited to these.

Preferably, the brush roll is provided with a brush through a sticking layer on the surface of a cylindrical stem.

The brush roll preferably rotates such that a contact part thereof moves in the same direction as that of the motion of the surface of the photoreceptor. If the contact part moves in the opposite direction, and there is excessive toner on the surface of the photoreceptor, toner removed by the brush roll may spill out and dirty the recording sheet and the apparatus. In the motion of the photoreceptor and the brush roll in the same direction as described above, the surface velocity ratio between them is preferably in the range from 1:1 to 1:2. If the rotation speed of the brush roll is smaller than that of the photoreceptor, the toner removal performance of the brush roll is reduced, thus cleaning defects easily occur, and if the rotation speed of the brush roll is greater than that of the photoreceptor, the toner removal performance is excessive to cause blade bounding or curving.

In the present invention, surface energy lowering agents at a moisture content of at most 5.0% by weight are preferably employed. It is provided onto the surface of the electrophotographic photoreceptor in the image forming apparatus, having the intermediate transfer body, whereby the surface energy lowering agent providing means is brought into contact with the surface of the electrophotographic photoreceptor.

EXAMPLE

Hereinafter, the present invention is explained in detail by showing examples, but embodiments of the invention are not limited to these examples. Incidentally, "part" in the following sentences represents "parts by weight".

Examples 1-6, Comparative Examples 1-7

<Preparation of Photoconductor 1>

Photoconductor 1 was produced as described below:

The surface of a 100 mm-diameter, 346 mm long cylindrical aluminum support member was cut and a conductive support having a surface roughness of Rz=1.5 (μm) was prepared.

<Intermediate Layer>

The following dispersion solution of the intermediate layer was diluted twofold with the same mixed solvent, and it was left to stand overnight. Then it was filtered by a filter (a 5-μm filter, RIGIMESH by Nihon Pall Corporation) to prepare the intermediate layer coating composition.

| | |
|---|---|
| Polyamide resin (Exemplified polyamide N-1) | 1 part |
| Titanium oxide SMT500SAS (by Teika Inc., Titanium oxide having average primary particle diameter of 35 nm subjected to primary process by silica/alumina and secondary process by methylhydrogen polysiloxane) | 3 parts |
| Methanol | 10 parts |

A sand mill was used as a dispersion machine to perform dispersion by a batch method for ten hours.

Using the aforementioned coating solution, it was coated on the aforementioned support so that the film thickness in a dried state would be 2 μm.

<Electric Charge Generating Layer>

Twenty parts of Y type titanylphthalocyanine (Cu-Kα titanylphthalocyanine having a black angle of 2θ (±0.2) and a maximum peak of 27.2 degrees according to characteristic X-ray diffraction spectral measurement), 10 parts of polyvinyl butyral resin (#6000-C: Denki Kagaku Kogyo Co., Ltd.), 700 parts of t-butyl acetate, and 300 parts of 4-methoxy-4-methyl-2-pentanone were mixed. A sand mill was used to disperse it for ten hours to prepare a composition for coating the electric charge generating layer. This composition was coated on the intermediate layer according to the dip coating method to produce an electric charge generating layer having a dry film thickness of 0.3 μm.

<Electric Charge Transport Layer>

Two hundred and twenty five parts of electric charge transport substance (4,4'-dimethyl-4"-(α-phenylstyryl)triphenylamine, 300 parts of polycarbonate (Polycarbonate Z having structure shown below, Molecular weight of 30,000, and water absorption coefficient of 0.23%), 6 parts of oxidation preventing agent (IRGANOX 1010 by Japan Ciba Geigy Co., Ltd.), 2000 parts of dichloromethane, and 1 part of silicone oil (KF-54 by Shin-Etsu Chemical Co. Ltd.) were mixed and dissolved to prepare a composition for coating the electric charge transport layer. This composition was coated on the above mentioned charge generating layer by the dip coating method to produce an electric charge transfer layer having a dry film thickness of 20 μm.

<Surface Layer>

Two hundred and twenty five parts of electric charge transport substance (4,4'-dimethyl-4"-(α-phenylstyryl)triphenylamine, 300 parts of polycarbonate (polycarbonate A, shown below: viscosity average molecular weight 30,000, and water absorption coefficient of 0.23%), hydrophobic silica (shown in Table 1), 6 parts of anti-oxidation agent (LS2626 by Sankyo Co., Ltd.), 2000 parts of 1,3-dioxolane, and 1 part of silicone oil (KF-54 by Shin-Etsu Chemical Co. Ltd.) were mixed and were circulated and dispersed by a circulation/dispersion apparatus capable of applying ultrasonic waves, whereby a composition for coating the surface was prepared. This composition was coated on the electric charge transport layer according to the aforementioned method of coating by regulation of circular quantity so as to have the dry film thickness reached 5 μm. Then it was dried at 110° C. for 70 minutes, whereby a photoconductor 1 was produced.

Polycarbonate Z

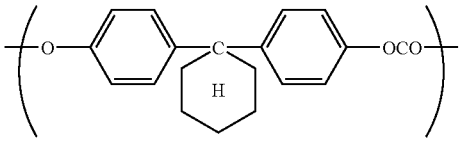

-continued

Polycarbonate A

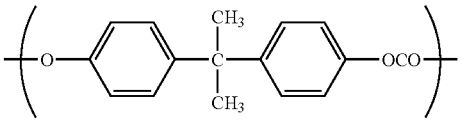

Preparation of Photoconductors 2 through 8

Photoconductors 2 through 8 were prepared in the same way as that used in the photoconductor 1, except that the inorganic minute particles in the surface layer and the binders in the intermediate layer were replaced by those shown in the Table 1.

TABLE 1

| Photo-receptor No. | Inorganic minute particles: Species | Particle diameter (nm) (*) | Amount | Surface treating agent |
|---|---|---|---|---|
| 1 | Silica | 40 | 10 | Hexamethyl-disilazane |
| 2 | Silica | 12 | 10 | Octylsilane |
| 3 | Silica | 60 | 10 | Dimethylsilicone |
| 4 | Silica | 35 | 15 | Aminosilane/ Hexamethyl-disilazane |
| 5 | Silica | 120 | 20 | Hexamethyl-disilazane |
| 6 | Silica | 40 | 10 | None |
| 7 | — | — | 0 | — |
| 8 | Titanium Oxide | 90 | 20 | Octylsilane |

| Photo-receptor | Inorganic minute particles Hydrophobicity (%) | Intermediate layer Binder | DH (J/g) |
|---|---|---|---|
| 1 | 80 | N-1 | 5.5 |
| 2 | 72 | N-1 | 7.3 |
| 3 | 74 | N-1 | 6.2 |
| 4 | 55 | N-5 | 9.3 |
| 5 | 64 | N-1 | 7.8 |
| 6 | 0 | N-1 | 17.7 |
| 7 | — | N-1 | 2.1 |
| 8 | 83 | N-7 | 2.5 |

(*) Number average primary particle diameter

Preparation of Toners

Toner No. 1 was prepared shown below.

Toner original particle 1

Polymerization of Resin Particle A (First Stage Polymerization)

Charged into a 5 L reaction vessel fitted with a stirrer, a temperature sensor, a cooling pipe, and a nitrogen introducing unit, was a solution which was prepared by dissolving 8 g of sodium dodecylsulfate in 3 L of ion-exchanged water. While stirring at a rate of 230 rpm under a flow of nitrogen, the interior temperature was raised to 80° C. After the temperature rose, a solution which was prepared by dissolving 10 g of potassium persulfate in 200 g of ion-exchanged water was added, and the temperature was again raised to 80° C. After dripping, over one hour, a polymerizable monomer mixture liquid shown below, while stirring, the resulting mixture underwent polymerization at 80° C. for two hours, whereby resin particle 1H were prepared.

| | |
|---|---|
| Styrene | 500 g |
| n-Butyl acrylate | 220 g |
| Methacrylic acid | 80.0 g |
| n-Octylmercaptan | 14.0 g |

(Second Stage Polymerization)

Charged into a 5 L reaction vessel fitted with a stirrer, a temperature sensor, a cooling pipe, and a nitrogen introducing unit, was a solution which was prepared by dissolving 7 g of sodium polyoxyethylene-2-dodecylether sodium sulfate in 800 ml of ion-exchanged water. After rising the temperature to 98° C., 210 g of above resin particle dispersion (1H) and a polymerizable monomer solution prepared by dissolving, at 90° C., the following monomers, were added, and the resulting mixture was mix-dispersed over one hour, employing a mechanical type homogenizer having a circular pass, "CLEARMIX" (produced by M Technique Co.), whereby a dispersion incorporating emulsified particles (oil droplets) was prepared.

| | |
|---|---|
| Styrene | 170 g |
| n-Butyl acrylate | 90 g |
| n-Octylmercaptan | 2.0 g |
| Ester wax WEP-3 (Product of NOF CORPORATION) | 200 g |

Subsequently, an initiator solution prepared by dissolving 6 g of potassium persulfate in 200 ml of ion-exchanged water was added to the above dispersion, and while stirring, the resulting system underwent polymerization at 82° C. for one hour.

(Third Stage Polymerization)

A solution prepared by dissolving 11 g of potassium persulfate in 400 ml of ion-exchange water was added and at 82° C., a polymerizable monomer solution composed of;

| | |
|---|---|
| Styrene | 420 g |
| 2-ethylhexyl acrylate | 135 g |
| Methacrylic acid | 25 g |
| n-Octylmercaptan | 7.5 g |

was dripped over one hour. After dripping, while stirring and heating, the resulting mixture underwent polymerization over two hours. Thereafter, the resulting reaction products were cooled to 28° C, whereby Resin Particle A was prepared.

Polymerization of Resin Particle A

Charged into a 5 L reaction vessel fitted with a stirrer, a temperature sensor, a cooling pipe, and a nitrogen introducing unit, was a solution which was prepared by dissolving 2.3 g of sodium dodecylsulfate in 3 L of ion-exchanged water. While stirring at a rate of 230 rpm under a flow of nitrogen, the interior temperature was raised to 80° C. After the temperature rose, a solution which was prepared by dissolving 10 g of potassium persulfate in 200 g of ion-exchanged water was added, and the temperature was again raised to 80° C. After dripping, over one hour, a polymerizable monomer mixture liquid shown below, while stirring, the resulting mixture underwent polymerization at 80° C. for two hours, whereby resin particle B were prepared.

| | |
|---|---|
| Styrene | 520 g |
| n-Butyl acrylate | 210 g |
| Methacrylic acid | 68.0 g |
| n-Octylmercaptan | 16.0 g |

Preparation of Colorant Dispersion

While stirring a solution prepared by dissolving 90 g of sodium dodecyl sulfate in 1,600 ml of ion-exchanged water, 420 g of carbon black "REGAL 330R" (produced by Cabot Co.) was gradually added. Subsequently, the resulting mixture was dispersed employing a stirrer, "CLEARMIX" (produced by M Technique Co.), whereby dispersion of colorant particles was prepared. The diameter of the colorant particles in above colorant dispersion was determined employing an electrophoretic light scattering photometer, "ELS-800" (produced by Otsuka Electronics Co., Ltd.), resulting in 110 nm in terms of the volume based median diameter.

(Coagulation/Fusion Process)

Charged into a 5 L reaction vessel fitted with a stirrer, a temperature sensor, a cooling pipe, and a nitrogen introducing unit, were 300 g in terms of solids of Resin Particle A, 1,400 g of ion-exchanged water, 1120 g of colorant dispersion, and a solution prepared by dissolving 3 g of sodium polyoxyethylene-2-dodecylether sodium sulfate in 120 ml of ion-exchanged water, and the temperature of the resulting mixture was controlled to 30° C. Thereafter, the pH was adjusted to 10 by the addiction of a 5N aqueous sodium hydroxide solution. Subsequently, an aqueous solution prepared by dissolving 35 g of magnesium chloride in 35 ml of ion-exchanged water was added while stirring at 30° C. over 10 minutes. After allowing to stand for 10 minutes, the temperature was heated up to 90° C. over 60 minutes and 260 g of Resin B was added. The particle growth reaction was allowed to continue while maintained at 90° C. When the particle diameter reached the specified value, the particle growth was terminated by the addition of an aqueous solution prepared by dissolving 150 g of sodium chloride in 600 ml of ion-exchanged water. Further, as a fusion process, until the average circularity determined employing "FPIA-2100" reached to predetermined value, fusion between particles was progressed wile stirring at a liquid temperature of 98° C. Thereafter, the liquid was cooled to 30° C., and the pH was adjusted to 4.0 by the addition hydrochloric acid, followed by termination of stirring.

(Washing/Drying Process)

The particles prepared by the coagulation/fusion process was subjected solid-liquid separation employing a basket type centrifuge, "MARK III Type No. 60×40", produced by MATSUMOTO KIKAI MFG. Co., Ltd.), and a toner particle wet cake was prepared. The resulting wet cake was washed with ion-exchanged water of a temperature of 45° C. in the above basket type centrifuge, until the electrical conductivity of the effluent reached 5 μS/cm. Thereafter, the washed cake was transferred to "FLUSH JET DRYER" (produced by Seishin Enterprise Co., Ltd.) and dried until the water content reached 0.5% by weight, whereby toner original particle 1 was prepared.

(Preparation-1 of Surface Energy Lowering Agent)

A slurry of milk of lime, at a solid concentration of 12.6% by weight and a BET specific surface area of 10 $cm^2/g$, was prepared. The above slurry of milk of lime was subjected to wet levigation, employing DYNO-MLL (Type KDL-pilot, produced by Shinmaru Enterprises Corp.) to reach a BET specific surface area of 20 $m^2/g$ and a precipitation volume rate of 80 ml/60 minutes. The resultant slurry of milk of lime was dehydrated to reach a solid concentration of 40%. On the other hand, 570 g of stearic acid (at a neutralization value of 197) was placed in a kneader and melted at 100° C. Subsequently, 222 g of the above milk of lime at a solid concentration of 40%, prepared as above, and 97.6 g of water were added to the resultant melted stearic acid. The blending ratio was higher fatty acid/$Ca(OH)_2$/water (in mol ratio)=2/1.2/12.8 in terms of conversion. In such a state, blending was carried out for 5-30 minutes, whereby a reaction between stearic acid and calcium hydroxide was completed.

The reaction products were subjected to vacuum drying, whereby a calcium soap was prepared. The resultant calcium soap was subjected to IR analysis, and the peak of the carboxyl group of 1,700 $cm^{-1}$ shifted to 1,600 $cm^{-1}$, whereby formation of calcium stearate was confirmed.

Calcium stearate PM1 was prepared as above. Fatty acid calcium which was prepared by allowing calcium oxide to react with a mixture of stearic acid/palmitic acid at a ratio of 70/30, in the same manner as above, was designated as PM2, while zinc stearate which was prepared by allowing stearic acid to react with zinc salts was designated as PM3.

(Preparation of Toner Particle for Example 1)

Added to the resulting toner original particle 1 were 1% by weight of hydrophobic silica (a number average primary particle diameter of 12 nm), 0.3% by weight of hydrophobic titania (at a number average primary particle diameter of 20 nm), and 0.1% by weight of zinc stearate as the surface energy lowering agent, and the resulting composition was mixed employing HENSCHEL MIXER, whereby Toner 1 was prepared.

(Preparation of Toner Original Particles 2-8 for the Toner)

Toner original particles 2-8 for the toner were prepared in the same manner as toner original particles 2-8, except that the monomer mixture in the process of polymerization of Resin Particle Dispersion A was replaced by those shown in Tables 2 and 3 and the particle diameter and the circularity during the coagulation/fusion process were modified as shown in Tables 2 and 3.

TABLE 2

| | Polymerization Process of Resin Particle A | | | Coagulation/ Fusion Process | |
|---|---|---|---|---|---|
| | First step | 2nd step | 3rd step | Particle diameter | Circularity |
| | Toner original particle 1 | | | | |
| Styrene | 500 | 170 | 420 | 6.3 μm | 0.965 |
| n-Butyl acrylate | 220 | 90 | | | |
| 2-Ethylhexyl acrylate | | | 135 | | |
| Methacrylic acid | 80 | | 25 | | |
| Acrylic cid | | | | | |
| n-Octylmercaptan | 14 | 2 | 7.5 | | |
| Wax species | | WEP-3 | | | |
| Wax amount | | 200 | | | |
| Resin particle liquid (1H) | | 210 | | | |
| | Toner original particle 2 | | | | |
| Styrene | 520 | 185 | 490 | 6.3 μm | 0.97 |
| n-Butyl acrylate | 200 | 115 | 175 | | |
| 2-Ethylhexyl acrylate | | | | | |
| Methacrylic acid | 85 | | 35 | | |
| Acrylic cid | | | | | |
| n-Octylmercaptan | 14 | 3 | 10 | | |
| Wax species | | WEP-3 | | | |
| Wax amount | | 200 | | | |
| Resin particle liquid (1H) | | 210 | | | |

TABLE 2-continued

| | Polymerization Process of Resin Particle A | | | Coagulation/ Fusion Process | |
|---|---|---|---|---|---|
| | First step | 2nd step | 3rd step | Particle diameter | Circularity |
| | Toner original particle 3 | | | | |
| Styrene | 480 | 225 | 440 | 5.6 μm | 0.97 |
| n-Butyl acrylate | 250 | 110 | 120 | | |
| 2-Ethylhexyl acrylate | | | | | |
| Methacrylic acid | 68 | | | | |
| Acrylic cid | | | 40 | | |
| n-Octylmercaptan | 16 | 1 | 5 | | |
| Wax species | | WEP-3 | | | |
| Wax amount | | 190 | | | |
| Resin particle liquid (1H) | | 260 | | | |
| | Toner original particle 4 | | | | |
| Styrene | 520 | 180 | 420 | 5.6 μm | 0.965 |
| n-Butyl acrylate | 200 | 100 | | | |
| 2-Ethylhexyl acrylate | | | 125 | | |
| Methacrylic acid | 85 | | 45 | | |
| Acrylic cid | | | | | |
| n-Octylmercaptan | 14 | 1 | 7.5 | | |
| Wax species | | HNP-10 | | | |
| Wax amount | | 150 | | | |
| Resin particle liquid (1H) | | 210 | | | |

TABLE 3

| | Polymerization Process of Resin Particle A | | | Coagulation/ Fusion Process | |
|---|---|---|---|---|---|
| | First step | 2nd step | 3rd step | Particle diameter | Circularity |
| | Toner original particle 5 | | | | |
| Styrene | 480 | 245 | 435 | 6.5 μm | 0.965 |
| n-Butyl acrylate | 250 | 120 | 130 | | |
| 2-Ethylhexyl acrylate | | | | | |
| Methacrylic acid | 68 | | 33 | | |
| Acrylic cid | | | | | |
| n-Octylmercaptan | 16 | 1.5 | 8 | | |
| Wax species | | WEP-5 | | | |
| Wax amount | | 190 | | | |
| Resin particle liquid (1H) | | 260 | | | |
| | Toner original particle 6 | | | | |
| Styrene | 480 | 180 | 520 | 6.5 μm | 0.96 |
| n-Butyl acrylate | 250 | 100 | 160 | | |
| 2-Ethylhexyl acrylate | | | | | |
| Methacrylic acid | 68 | | 55 | | |
| Acrylic cid | | | | | |
| n-Octylmercaptan | 16 | 1 | 10 | | |
| Wax species | | WEP-3 | | | |
| Wax amount | | 150 | | | |
| Resin particle liquid (1H) | | 210 | | | |
| | Toner original particle 7 | | | | |
| Styrene | 480 | 210 | 510 | 6.5 μm | 0.96 |
| n-Butyl acrylate | 250 | 70 | 150 | | |
| 2-Ethylhexyl acrylate | | | | | |
| Methacrylic acid | 68 | | 50 | | |
| Acrylic cid | | | | | |
| n-Octylmercaptan | 16 | 1.5 | 10 | | |
| Wax species | | WEP-5 | | | |
| Wax amount | | 150 | | | |
| Resin particle liquid (1H) | | 260 | | | |
| | Toner original particle 8 | | | | |
| Styrene | 520 | 235 | 570 | 5.6 μm | 0.97 |
| n-Butyl acrylate | 200 | 75 | 140 | | |

TABLE 3-continued

| | Polymerization Process of Resin Particle A | | | Coagulation/ Fusion Process | |
|---|---|---|---|---|---|
| | First step | 2nd step | 3rd step | Particle diameter | Circularity |
| 2-Ethylhexyl acrylate | | | | | |
| Methacrylic acid | 85 | 30 | | | |
| Acrylic cid | | | | | |
| n-Octylmercaptan | 14 | 3 | 10 | | |
| Wax species | | WEP-3 | | | |
| Wax amount | | 180 | | | |
| Resin particle liquid (1H) | | 210 | | | |

The terms WEP-3, WEP-5 and HNP-10 shown in Table 3 are wax below.

WEP-3: Ester wax product of NOF CORPORATION

WEP-5: Ester wax product of NOF CORPORATION

HNP-10: Paraffin wax product of Nippon Seiro, Co., Ltd (Preparation of Developer)

Ester Wax Product of NOF CORPORATION

Developers were prepared by mixing silicone resin-coated ferrite carriers of a volume average particle diameter of 60 μm to reach a toner concentration of 6% with each of Toner Particles shown in Tables 2 and 3.

(Preparation of Toner Particles, Examples 2-6, and Comparative Toners 1-7)

Toner particles for Examples 2-6, and Comparative toners 1-7 were prepared in the same way as toner particle for Example 1 except that the toner original particle, the surface energy lowering agent and its amount were modified as shown in Table 4.

the above developers, the following evaluation was carried out by comparing characteristics.

(Evaluation)

Each of the photoreceptors and developers, prepared as above, was loaded in full-color digital copier "8050" which had been modified to increase the linear rate to 300 mm/second, and Examples 1-6 and Comparative Examples 1-7 were evaluated. Center lower density, toner dots near characters, image evaluation, toner transferability, and cleaning properties were evaluated in such a manner that an original image composed of each one quarter of a text image at a pixel ratio of 7%, a portrait, a solid white image, and a solid black image was printed onto A4 acid-free paper. Under each of the ambient conditions at high temperature and high humidity (HH: 30° C. and 80% RH) which was assumed to be the severest condition, and at low temperature and low humidity (LL: 10° C. and 20% RH), 100,000 sequential sheets were printed, and evaluation was carried out.

"Formation of Center Low Density"

Characters were enlarged and any presence or absence of center low density was visually observed. Evaluation criteria were as follows:

A: up to completion of 200,000 prints, no marked center low density was noted

B: up to completion of 100,000 prints, no marked center low density was noted

D: marked center low density was noted prior to 100,000 prints,

"Evaluation of Toner Dots Near Characters"

Instead of a dot image which is composed of characters, a 10% halftone dot image was formed and scattered toner particles around the dot was observed via a hand magnifying glass.

TABLE 4

| | Photo-receptor No. | *1 | Variation of Endothermic Energy ΔH J/g | Toner Host Particles No. | Tg ° C. | Interfacial Adhesion Force N | Surface Energy Lowering Agent | Amount of Surface Energy Lowering Agent weight % |
|---|---|---|---|---|---|---|---|---|
| Example 1 | 1 | 40 | 5.5 | 5 | 38 | 2.9 | PM1 | 0.01 |
| Example 2 | 2 | 12 | 7.6 | 6 | 35 | 3.3 | PM2 | 0.05 |
| Example 3 | 3 | 60 | 6.2 | 3 | 35 | 2.5 | PM3 | 0.1 |
| Example 4 | 4 | 35 | 9.3 | 4 | 30 | 2.8 | PM1 | 0.15 |
| Example 5 | 8 | 90 | 2.5 | 2 | 22 | 1.8 | PM2 | 0.02 |
| Example 6 | 8 | 90 | 2.5 | 1 | 27 | 1.2 | PM3 | 0.05 |
| Comparative Example 1 | 1 | 40 | 5.5 | 7 | 42 | 3.8 | PM1 | 0.07 |
| Comparative Example 2 | 2 | 12 | 7.6 | 8 | 47 | 4.1 | PM2 | 0.03 |
| Comparative Example 3 | 5 | 120 | 7.8 | 6 | 35 | 3.3 | PM3 | 0.05 |
| Comparative Example 4 | 6 | 40 | 17.7 | 4 | 30 | 2.8 | PM1 | 0.1 |
| Comparative Example 5 | 7 | none | 2.1 | 2 | 22 | 1.8 | PM2 | 0.08 |
| Comparative Example 6 | 1 | 40 | 5.5 | 5 | 38 | 2.9 | none | — |
| Comparative Example 7 | 5 | 120 | 7.8 | 8 | 47 | 4.1 | PM3 | 0.01 |

*1: Diameter of Inorganic Particles Number Average Diameter of Primary Particles nm By employing photoreceptors of Examples 1-6 and Comparative Examples 1-7 listed in Table 4, and developers composed of toner particles for Example 1-6 and Comparative Examples 1-7, which were prepared in the same manner as A: up to completion of 200,000 prints, only minimal toner scattering was noted B: up to completion of 100,000 prints, only minimal toner scattering was noted D: prior to 100,000 prints, toner scattering increased (to a commercially problematic level)

"Cleaning Evaluation"

The presence or absence of passing-through of the toner due to abrasion of the photoreceptor and the cleaning blade, and the presence or absence of blade twist (being a phenomenon in which the blade is reversely bent) were evaluated.

A: up to completion of 200,000 prints, neither toner passing-through nor blade twisting occurred B: up to completion of 100,000 prints, neither toner passing-through nor blade twisting occurred D: prior to 100,000 prints, toner passing-through and blade twisting occurred Toner Transferability (after completion of 200,000 prints, an image at 60 mg/cm$^2$ was formed on the photoreceptor, and adhesion amount per area (f in mg/cm$^2$) transferred onto the transfer paper was determined, whereby a transfer ratio was obtained via the following calculation)

$$\text{Toner transfer ratio}=(f/60)\times 100(\%)$$

A: a toner transfer ratio of at least 85%; considered as good

B: a toner transfer ratio of 65-84%; considered to be commercially viable

D: a toner transfer ratio of at most 64%; considered to be commercially unviable Further, while changing the fixing temperature in 2° C. increments between 120 and 170° C., a 1.5 cm×1.5 cm solid images (at an adhesion amount of 2.0 mg/cm$^2$) were prepared. Each of the resultant images was folded into two parts along the center, and image peeling resistance was visually evaluated.

The temperature between the fixing temperature at which the image was peeled slightly and the lower limit fixing temperature at which no peeling occurred was designated as the fixing lower limit temperature.

A: the fixing lower limit temperature was less than 142° C.

B: the lower limit fixing temperature was 142° C.-146° C.

C: the lower limit fixing temperature was 146° C.-152° C.; considered to be commercially viable D: the lower limit fixing temperature was at least 152° C.; considered to be commercially unviable Table 5 shows the results.

TABLE 5

| Table 5 | Peeling Resistance | Center Lower Density | Toner Dots Near Characters | Cleaning Properties | Transfer-ability |
|---|---|---|---|---|---|
| Example 1 | C | B | A | A | A |
| Example 2 | B | B | B | A | B |
| Example 3 | B | A | B | B | A |
| Example 4 | B | B | A | A | B |
| Example 5 | A | B | B | B | B |
| Example 6 | A | A | B | B | B |
| Comparative Example 1 | D | B | B | B | B |
| Comparative Example 2 | D | B | B | B | B |
| Comparative Example 3 | B | B | D | D | B |
| Comparative Example 4 | B | B | B | D | B |
| Comparative Example 5 | A | D | B | D | D |
| Comparative Example 6 | C | D | D | B | D |
| Comparative Example 7 | D | B | D | B | B |

As can be seen from Table 5, examples employing the photoreceptor and the developer (the toner) according to the present invention exhibit excellent peeling resistance, center lower density resistance, reduced toner dots near characters, desired cleaning properties, and higher transferability.

Example 21-30, Comparative Toners 21-27

Photoreceptor

The photoreceptors 1-8 prepared in the Examples described above were employed.

(Preparation of Toner Particle)

Added to the resulting toner original particle 1 were 1% by weight of hydrophobic silica (a number average primary particle diameter of 12 nm), 0.3% by weight of hydrophobic titania (at a number average primary particle diameter of 20 nm), and 0.1% by weight of zinc stearate as the surface energy lowering agent, and the resulting composition was mixed employing HENSCHEL MIXER, whereby Toner 21 was prepared.

(Preparation of Toners 22-28)

Toners 22-28 were prepared in the same manner as toner 1, except that the monomer mixture in the process of polymerization of Resin Particle Dispersion A was replaced by those shown in Tables 6 and 7 and the particle diameter and the circularity during the coagulation/fusion process were modified as shown in Tables 6 and 7.

TABLE 6

| | Polymerization Process of Resin Particle A | | | Coagulation/ Fusion Process | |
|---|---|---|---|---|---|
| | First step | 2nd step | 3rd step | Particle diameter | Circularity |
| | Toner original particle 21 | | | | |
| Styrene | 500 | 170 | 420 | 6.3 μm | 0.965 |
| n-Butyl acrylate | 220 | 90 | | | |
| 2-Ethylhexyl acrylate | | | 135 | | |
| Methacrylic acid | 80 | | 25 | | |
| Acrylic cid | | | | | |
| n-Octylmercaptan | 14 | 2 | 7.5 | | |
| Wax species | | WEP-3 | | | |
| Wax amount | | 200 | | | |
| Resin particle liquid (1H) | | 210 | | | |
| | Toner original particle 22 | | | | |
| Styrene | 520 | 185 | 490 | 6.3 μm | 0.97 |
| n-Butyl acrylate | 200 | 115 | 175 | | |
| 2-Ethylhexyl acrylate | | | | | |
| Methacrylic acid | 85 | | 35 | | |
| Acrylic cid | | | | | |
| n-Octylmercaptan | 14 | 3 | 10 | | |
| Wax species | | WEP-3 | | | |
| Wax amount | | 200 | | | |
| Resin particle liquid (1H) | | 210 | | | |
| | Toner original particle 23 | | | | |
| Styrene | 480 | 225 | 440 | 5.6 μm | 0.97 |
| n-Butyl acrylate | 250 | 110 | 120 | | |
| 2-Ethylhexyl acrylate | | | | | |
| Methacrylic acid | 68 | | | | |
| Acrylic cid | | | 40 | | |
| n-Octylmercaptan | 16 | 1 | 5 | | |
| Wax species | | WEP-3 | | | |
| Wax amount | | 190 | | | |
| Resin particle liquid (1H) | | 260 | | | |
| | Toner original particle 24 | | | | |
| Styrene | 520 | 180 | 420 | 5.6 μm | 0.965 |
| n-Butyl acrylate | 200 | 100 | | | |

TABLE 6-continued

| | Polymerization Process of Resin Particle A | | | Coagulation/ Fusion Process | |
|---|---|---|---|---|---|
| | First step | 2nd step | 3rd step | Particle diameter | Circularity |
| 2-Ethylhexyl acrylate | | | 125 | | |
| Methacrylic acid | 85 | | 45 | | |
| Acrylic cid | | | | | |
| n-Octylmercaptan | 14 | 1 | 7.5 | | |
| Wax species | | HNP-10 | | | |
| Wax amount | | 150 | | | |
| Resin particle liquid (1H) | | 210 | | | |

TABLE 7

| | Polymerization Process of Resin Particle A | | | Coagulation/ Fusion Process | |
|---|---|---|---|---|---|
| | First step | 2nd step | 3rd step | Particle diameter | Circularity |
| | Toner original particle 25 | | | | |
| Styrene | 480 | 245 | 435 | 6.5 μm | 0.965 |
| n-Butyl acrylate | 250 | 120 | 130 | | |
| 2-Ethylhexyl acrylate | | | | | |
| Methacrylic acid | 68 | | 33 | | |
| Acrylic cid | | | | | |
| n-Octylmercaptan | 16 | 1.5 | 8 | | |
| Wax species | | WEP-5 | | | |
| Wax amount | | 190 | | | |
| Resin particle liquid (1H) | | 260 | | | |
| | Toner original particle 26 | | | | |
| Styrene | 480 | 180 | 520 | 6.5 μm | 0.96 |
| n-Butyl acrylate | 250 | 100 | 160 | | |
| 2-Ethylhexyl acrylate | | | | | |
| Methacrylic acid | 68 | | 55 | | |
| Acrylic cid | | | | | |
| n-Octylmercaptan | 16 | 1 | 10 | | |
| Wax species | | WEP-3 | | | |
| Wax amount | | 150 | | | |
| Resin particle liquid (1H) | | 210 | | | |
| | Toner original particle 27 | | | | |
| Styrene | 480 | 210 | 510 | 6.5 μm | 0.96 |
| n-Butyl acrylate | 250 | 70 | 150 | | |
| 2-Ethylhexyl acrylate | | | | | |
| Methacrylic acid | 68 | | 50 | | |
| Acrylic cid | | | | | |
| n-Octylmercaptan | 16 | 1.5 | 10 | | |
| Wax species | | WEP-5 | | | |
| Wax amount | | 150 | | | |
| Resin particle liquid (1H) | | 260 | | | |
| | Toner original particle 28 | | | | |
| Styrene | 520 | 235 | 570 | 5.6 μm | 0.97 |
| n-Butyl acrylate | 200 | 75 | 140 | | |

TABLE 7-continued

| | Polymerization Process of Resin Particle A | | | Coagulation/ Fusion Process | |
|---|---|---|---|---|---|
| | First step | 2nd step | 3rd step | Particle diameter | Circularity |
| 2-Ethylhexyl acrylate | | | | | |
| Methacrylic acid | 85 | 30 | | | |
| Acrylic cid | | | | | |
| n-Octylmercaptan | 14 | 3 | 10 | | |
| Wax species | | WEP-3 | | | |
| Wax amount | | 180 | | | |
| Resin particle liquid (1H) | | 210 | | | |

The terms WEP-3, WEP-5 and HNP-10 shown in Table 3 are wax below.

WEP-3: Ester wax product of NOF CORPORATION

WEP-5: Ester wax product of NOF CORPORATION

HNP-10: Paraffin wax product of Nippon Seiro, Co., Ltd (Preparation of Developer)

Ester Wax Product of NOF CORPORATION

Developers were prepared by mixing silicone resin-coated ferrite carriers of a volume average particle diameter of 60 μm to reach a toner concentration of 6% with each of Toner Particles shown in Tables 6 and 7.

(Preparation-2 of Surface Energy Lowering Agent)

Sodium stearate was dissolved in water and a 15% by weight solution was prepared. Further, zinc sulfate was dissolved in water and a 25% by weight solution was prepared. A 2-liter receiving vessel fitted with a 6 cm turbine blade was prepared, and the turbine blade was rotated at 350 rpm. The above sodium stearate solution was charged into the receiving vessel and the solution temperature was regulated to 80° C. The zinc sulfate solution, maintained at 80° C., was dripped into the receiving vessel over 30 minutes. The equivalent ratio of sodium stearate to zinc sulfate was regulated to 0.98, and blending was carried out so that the amount of metal soap slurry reached 500 g. After completion of the total mixing, ripening was carried out for 10 minutes at a temperature state during reaction, whereby the reaction was terminated. Subsequently, the metal soap slurry, prepared as above, was washed twice with water, and further washed with water. The resultant metal soap cake was dried at 110° C. and then solidified under a pressure of $1.47\times10^7$ Pa (150 kg/cm$^2$), followed by being allowed to stand at 30° C. and 80% relative humidity for 24 hours, whereby solid zinc stearate materials which differed in moisture content, shown in Table 8, were prepared. The differing moisture content was achieved by changing the drying time at 110° C. Table 8 shows types of photoreceptors and developers (toners) together with the content ratio of each of the surface energy lowering agents.

TABLE 8

| | Photo-receptor No. | *1 | Variation of Endothermic Energy ΔH J/g | Toner No. | Tg ° C. | Interfacial Adhesion Force N | Surface Energy Lowering Agent | Moisture Content % |
|---|---|---|---|---|---|---|---|---|
| Example 21 | 1 | 40 | 5.5 | 25 | 38 | 2.9 | Zn stearate | 1 |
| Example 22 | 1 | 40 | 5.5 | 26 | 35 | 3.3 | Zn stearate | 1 |
| Example 23 | 2 | 12 | 7.6 | 25 | 38 | 2.9 | Zn stearate | 1 |
| Example 24 | 2 | 12 | 7.6 | 26 | 35 | 3.3 | Zn stearate | 1 |
| Example 25 | 3 | 60 | 6.2 | 23 | 35 | 2.5 | Zn stearate | 0.1 |

TABLE 8-continued

| | Photo-receptor No. | *1 | Variation of Endothermic Energy ΔH J/g | Toner No. | Tg ° C. | Interfacial Adhesion Force N | Surface Energy Lowering Agent | Moisture Content % |
|---|---|---|---|---|---|---|---|---|
| Example 26 | 3 | 60 | 6.2 | 24 | 30 | 2.8 | Zn stearate | 1 |
| Example 27 | 4 | 35 | 9.3 | 23 | 35 | 2.5 | Zn stearate | 1 |
| Example 28 | 4 | 35 | 9.3 | 24 | 30 | 2.8 | Zn stearate | 4.5 |
| Example 29 | 8 | 90 | 2.5 | 22 | 22 | 1.8 | Ca stearate | 3 |
| Example 30 | 8 | 90 | 2.5 | 21 | 27 | 1.2 | Ca stearate | 3 |
| Comparative Example 21 | 1 | 40 | 5.5 | 27 | 42 | 3.8 | Zn stearate | 1 |
| Comparative Example 22 | 2 | 12 | 7.6 | 28 | 47 | 4.1 | Zn stearate | 1 |
| Comparative Example 23 | 5 | 120 | 7.8 | 26 | 35 | 3.3 | Zn stearate | 1 |
| Comparative Example 24 | 6 | 40 | 17.7 | 24 | 30 | 2.8 | Zn stearate | 1 |
| Comparative Example 25 | 7 | none | 2.1 | 26 | 35 | 3.3 | Zn stearate | 5.5 |
| Comparative Example 26 | 5 | 120 | 7.8 | 28 | 47 | 4.1 | Zn stearate | 1 |
| Comparative Example 27 | 3 | 60 | 6.2 | 24 | 30 | 2.8 | none | — |

*1: Inorganic Particle Diameter/Number Average Diameter of Primary Particles nm (Evaluation)

Photoreceptors and developers (toners), prepared as above, were combined as shown in Table 9, and evaluation was carried out in the same manner as in Example 1, employing a full color digital copier 8050 manufactured by Konica Minolta Business Technologies Co., Ltd, modified that each of cleaning device was replaced by a cleaning device having a device providing the surface energy lowering agent as shown in FIG. 5, and running speed was enhanced to line speed of 300 mm/sec.

Table 9 shows the results.

TABLE 9

| | Peeling Resistance | Center Lower Density | Toner Dots Near Characters | Cleaning Properties | Transfer-ability |
|---|---|---|---|---|---|
| Example 21 | A | A | A | A | A |
| Example 22 | A | B | B | A | B |
| Example 23 | A | A | A | A | A |
| Example 24 | A | B | B | B | B |
| Example 25 | B | B | B | B | B |
| Example 26 | C | A | A | B | A |
| Example 27 | B | B | B | A | B |
| Example 28 | C | A | A | A | A |
| Example 29 | A | B | B | B | B |
| Example 30 | A | B | B | B | B |
| Comparative Example 31 | D | B | B | A | B |
| Comparative Example 32 | D | A | A | B | A |
| Comparative Example 3 | A | B | B | D | B |
| Comparative Example 34 | C | D | B | D | D |
| Comparative Example 35 | A | D | D | D | D |
| Comparative Example 36 | D | B | B | D | B |
| Comparative Example 37 | C | D | B | B | D |

As can be seen from Table 9, examples employing the photoreceptor and the developer (the toner) according to the present invention exhibit excellent peeling resistance, center lower density resistance, reduced toner dots near characters, desired cleaning properties, and higher transferability.

The invention claimed is:

1. An image forming method comprising steps of;

visualizing an electrostatic latent image formed on an electrophotographic photoreceptor via development employing a developer comprising toner to form a toner image, transferring the toner image onto a recording material, fixing the toner image on the recording material, and removing a residual toner remaining on the electrophotographic photoreceptor, wherein a surface layer of the electrophotographic photoreceptor contains inorganic minute particles having a number average diameter of primary particles of 1-100 nm, and an endothermic energy variation amount (ΔH) of a coated layer of the electrophotographic photoreceptor is 0.1-10 J/g in differential scanning calorimetry, a glass transition temperature (Tg) of the toner is 20-40° C., and an interfacial adhesion force (Fr) between the toner and polytetrafluoroethylene is 1.0-3.5 N, and image formation is carried out in the presence of a surface energy lowering agent onto the electrophotographic photoreceptor, wherein the surface energy lowering agent is provided to the surface of the photoreceptor by employing the developer containing the surface energy lowering agent or the surface energy lowering agent is provided to the surface of the photoreceptor via surface energy lowering agent providing member.

2. The image forming method of claim 1, wherein the surface energy lowering agent is provided to the surface of the photoreceptor by employing the developer containing the surface energy lowering agent.

3. The image forming method of claim 2, wherein the toner contains the surface energy lowering agent in an amount of 0.005-0.3 percent by weight.

4. The image forming method of claim 3, wherein the toner contains the surface energy lowering agent in an amount of 0.01-0.2 percent by weight.

5. The image forming method of claim 1, wherein the surface energy lowering agent is provided to the surface of the photoreceptor via surface energy lowering agent providing member.

6. The image forming method of claim 5, wherein the surface energy lowering agent is provided to the surface of the photoreceptor via cleaning device.

7. The image forming method of claim 1, where in the surface energy lowering agent is a fatty acid metal salt.

8. The image forming method of claim 1, wherein the surface energy lowering agent is zinc stearate.

9. The image forming method of claim 1, wherein the moisture content of the surface energy lowering agent is at most 5.0% by weight measured under high temperature and high humidity conditions of 30° C. and 80% relative humidity.

10. The image forming method of claim 1, wherein the inorganic minute particles are composed of silica.

11. The image forming method of claim 1, wherein number average diameter of primary particles of the inorganic minute particles is 10-90 nm.

12. The image forming method of claim 1, wherein the inorganic minute particles have hydrophobicity of 50% or more in terms of methanol wettability.

13. The image forming method of claim 1, wherein the endothermic energy variation (ΔH) of the coated layer of the photoreceptor is 2.0-8.0 J/g.

14. The image forming method of claim 1, wherein the coated layer includes an interlayer, a photosensitive layer and a surface layer.

15. The image forming method of claim 1, wherein the surface layer of the electrophotographic photoreceptor comprises a binder resin having water absorption of at most 0.5% by weight.

16. An image forming method comprising steps of;

visualizing an electrostatic latent image formed on an electrophotographic photoreceptor via development employing a developer comprising toner to form a toner image, transferring the toner image onto a recording material, fixing the toner image on the recording material, and removing a residual toner remaining on the electrophotographic photoreceptor, wherein a surface layer of the electrophotographic photoreceptor contains inorganic minute particles having a number average diameter of primary particles of 1-100 nm, and an endothermic energy variation amount (ΔH) of a coated layer of the electrophotographic photoreceptor is 0.1-10 J/g in differential scanning calorimetry, a glass transition temperature (Tg) of the toner is 20-40° C., and image formation is carried out in the presence of a surface energy lowering agent onto the electrophotographic photoreceptor, wherein the surface energy lowering agent is provided to the surface of the photoreceptor by employing the developer containing the surface energy lowering agent or the surface energy lowering agent is provided to the surface of the photoreceptor via surface energy lowering agent providing member.

17. The image forming method of claim 16, wherein the surface energy lowering agent is provided to the surface of the photoreceptor by employing the developer containing the surface energy lowering agent.

18. The image forming method of claim 17, wherein the toner contains the surface energy lowering agent in an amount of 0.005-0.3 percent by weight.

19. The image forming method of claim 18, wherein the toner contains the surface energy lowering agent in an amount of 0.01-0.2 percent by weight.

20. The image forming method of claim 16, wherein the surface energy lowering agent is provided to the surface of the photoreceptor by employing the developer containing the surface energy lowering agent.

21. The image forming method of claim 16, wherein the surface energy lowering agent is provided to the surface of the photoreceptor via cleaning device.

22. The image forming method of claim 16, wherein the surface energy lowering agent is a fatty acid metal salt.

23. The image forming method of claim 16, wherein the surface energy lowering agent is zinc stearate.

24. The image forming method of claim 16, wherein the moisture content of the surface energy lowering agent is at most 5.0% by weight measured under high temperature and high humidity conditions of 30° C. and 80% relative humidity.

25. The image forming method of claim 16, wherein the inorganic minute particles are composed of silica.

26. The image forming method of claim 16, wherein number average diameter of primary particles of the inorganic minute particles is 10-90 nm.

27. The image forming method of claim 16, wherein the inorganic minute particles have hydrophobicity of 50% or more in terms of methanol wettability.

28. The image forming method of claim 16, wherein the endothermic energy variation (ΔH) of the coated layer of the photoreceptor is 2.0-8.0 J/g.

29. The image forming method of claim 16, wherein the coated layer includes an interlayer, a photosensitive layer and a surface layer.

30. The image forming method of claim 16, wherein the surface layer of the electrophotographic photoreceptor comprises a binder resin having water absorption of at most 0.5% by weight.

* * * * *